US006633264B2

(12) United States Patent
Kent et al.

(10) Patent No.: US 6,633,264 B2
(45) Date of Patent: Oct. 14, 2003

(54) EARTH COVERAGE REFLECTOR ANTENNA FOR GEOSYNCHRONOUS SPACECRAFT

(75) Inventors: Edward Jay Kent, Cherry Hill, NJ (US); Mysore Srinvasa Iyengar Sheshadri, Princeton Junction, NJ (US)

(73) Assignee: Lockheed Martin Corporation, Bethesda, MA (US)

( * ) Notice: Subject to any disclaimer, the term of this patent is extended or adjusted under 35 U.S.C. 154(b) by 0 days.

(21) Appl. No.: 09/742,176

(22) Filed: Dec. 21, 2000

(65) Prior Publication Data

US 2002/0080085 A1 Jun. 27, 2002

(51) Int. Cl.[7] ..... H01Q 13/00
(52) U.S. Cl. ..... 343/781 R; 343/840
(58) Field of Search ..... 343/781 P, 781 GA, 343/DIG. 2, 781 R, 840; H01Q 13/00

(56) References Cited

U.S. PATENT DOCUMENTS 5,402,137 A * 3/1995 Ramanujam et al. .... 343/781 P
5,847,681 A * 12/1998 Faherty et al. ..... 343/725
5,945,960 A * 8/1999 Luh ..... 343/757
6,031,506 A * 2/2000 Cooley et al. ..... 343/840

* cited by examiner

*Primary Examiner*—Hoanganh Le
(74) *Attorney, Agent, or Firm*—Duane Morris LLP

(57) ABSTRACT

A reflector antenna for use on a geosynchronous spacecraft or satellite for providing Earth coverage has a gain or directivity which is two or three dB greater at the edges than at the beam center, to provide coverage with more or less uniform field strength at the Earth's surface. The reflectors may be based on diverging prime focus or offset-feed parabolas, in which case the reflective surfaces of shaped reflectors have, in at least one plane, a central convex region and an "edge" convex region, separated by a concave region. The reflectors may be based on converging prime focus or offset-feed parabolas, in which case the reflective surfaces of the shaped reflectors have, in at least one plane, a concave central region.

7 Claims, 30 Drawing Sheets

EARTH COVERAGE BEAM ILLUSTRATION.

EARTH COVERAGE REFLECTOR ANTENNA FOR GEOSYNCHRONOUS SPACECRAFT

FIELD OF THE INVENTION

This invention relates to reflector antennas for spacecraft use, and more particularly to shaped reflectors for providing substantially uniform Earth illumination from a geosynchronous spacecraft.

BACKGROUND OF THE INVENTION

Spacecraft transponders are widely used for communications and television broadcasting. Some communications systems use a constellation of low-Earth-orbit (LEO) spacecraft travelling in elliptical orbits, such that some of the spacecraft are always available to serve various portions of the Earth's surface. These type of orbits require that a communication system provide for handoff or switching among the spacecraft as they succeed each other in providing service to a particular location. Other communications spacecraft and television broadcast spacecraft occupy geosynchronous orbits, in which the spacecraft appears to be at a constant location as seen from the Earth's surface. Such geosynchronous orbits eliminate the need for switching or handoff, but require a theoretical orbital altitude of about 35,786 kilometers or 22,237 miles, which is substantially greater than the altitude of those LEO spacecraft which provide service to a region. Consequently the payload of a geosynchronous spacecraft must provide a greater effective isotropic radiated power (EIRP) than a LEO spacecraft in order to provide the same signal strength at the Earth's surface.

Among the types of antennas used by geosynchronous spacecraft are direct-radiation horns. Ordinary horns tend to have H-plane radiation patterns which are more broad or wider than the E-plane radiation patterns when operated in the dominant mode, because of the characteristics of the H-plane aperture distribution. Since the Earth as seen from space is a circular disk, the differing E- and H-plane beamwidths of a conventional horn for direct radiation result in some energy being "lost" into space past the horizon in the H-plane if the E-plane pattern is proper, or result in insufficient coverage near the horizon in the E-plane if the H-plane coverage is adequate. Specialized horns can be used which are optimized for equal E- and H-plane coverage.

From a geosynchronous spacecraft orbiting at 35,786 km from the surface of the Earth, the Earth's radius of about 6,378 km results in an effective subtended angle of about 9°, corresponding to a subtended diameter of about 18°. Also, the horizon as seen from the geosynchronous spacecraft is more distant than the nadir by about 5893 km. Consequently, the path length between the spacecraft and the nadir is about 35786 km, while the path length between the spacecraft and the horizon is about 41,677 km. This difference in distance corresponds to a signal level difference at the horizon which is about three or four dB less than that at the nadir, assuming isotropic radiation from the spacecraft. *Antenna Handbook* by Lo and Lee, published 1988 by Van Nostrand Reinhold Company describes a direct-radiating circular horn array including a large multimode central horn surrounded by eight smaller horns, all fed with a beamformer, for generating an Earth-disk-coverage beam having a beam-center gain of about 15 dB, and a "beam-edge" gain of about 18 dB, which provides substantially constant power or energy distribution over a hemisphere of the Earth. Thus, the power flow per unit area tends to be about the same at the nadir and the horizon, and at locations inbetween. Horn radiator arrays tend to be bulky and heavy, and the beamformers required for such an array make the horn array undesirable for spacecraft applications. Lo et al. also mention corrugated horns for Earth-disk coverage, but indicate that they tend to be high in cost, difficult to fabricate, and relatively heavy.

Improved antennas are desired.

SUMMARY OF THE INVENTION

According to an aspect of the invention, a reflector antenna suited for providing Earth coverage from a geosynchronous spacecraft comprises a feed radiator for producing a directive feed beam, and a reflector intercepting the feed beam. The reflector is shaped for generating a generally axially symmetric reflector antenna beam about a beam axis, which symmetric reflector antenna beam has a directivity or theoretical gain in the range of about fourteen or fifteen db at the beam center, with the directivity increasing to about eighteen dB at angles of about 9° from the axis.

In a particular embodiment of this aspect of the invention, the reflector has a surface contour in at least a first plane which includes a convex center portion which is convex in a center region of the reflector as seen from the feed. The reflector also has a convex edge portion adjacent the edge of the reflector, which convex edge portion is convex as seen from the feed. The reflector also has a further concave portion, as seen from the feed, in a region lying between, and connecting, the convex center and edge portions. In one version of this embodiment, the feed is offset from an axis of the reflector and lies in a second plane orthogonal to the first plane. In this version, the reflector has a surface contour in the second plane in which the convex center portion has a maximum projection which is offset in the same direction as the feed is offset from the axis of the reflector. In another avatar, the shaped reflector is based on an underlying parabolic reflector, and the center portion of the shaped reflector is depressed below the corresponding contour of the underlying parabola, while the outer edge of the reflector is raised above the corresponding contour of the underlying parabola. In this avatar, the progression from negative distance or depression to positive distance or projection above the underlying parabolic reflector is monotonic except possibly at the very edge of the reflector.

In another manifestation of the invention, the reflector subtends only that portion of the directive feed beam which exhibits power levels greater than about 13 dB below the peak power level exhibited by the feed antenna beam, for providing a particular level of sidelobes of said reflector antenna beam. In another version of this manifestation which provides lower sidelobes than the 12-dB intercept, the reflector subtends only that portion of the directive feed beam which exhibits power levels greater than about 19 dB below the peak power level exhibited by the feed antenna beam.

DESCRIPTION OF THE INVENTION

Figure 1:
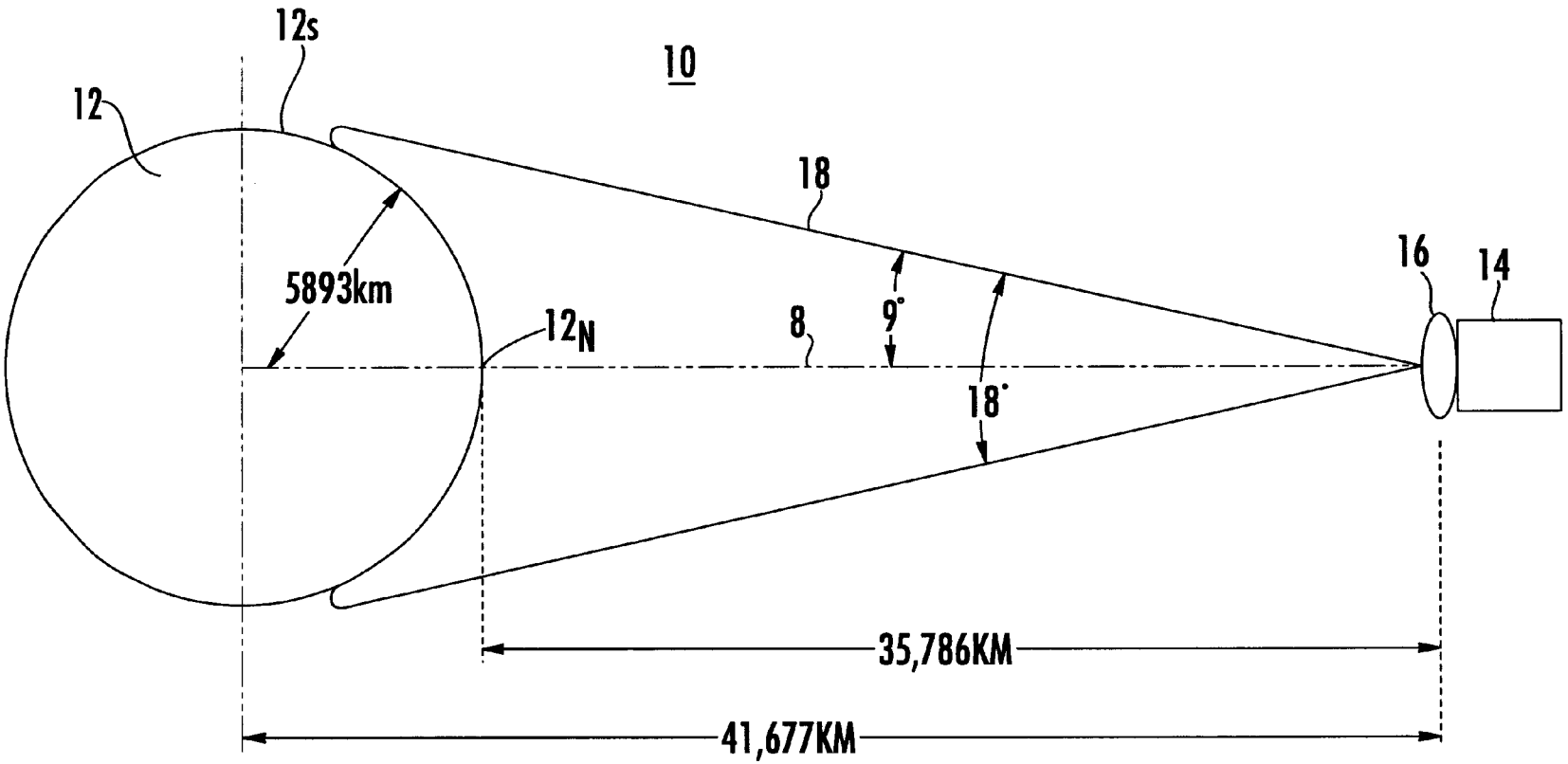
FIG. 1 is a simplified Illustration of a system including Earth and a communications spacecraft, showing a physical interpretation or rendition of the antenna beam for substantially equal-power-density reception over a hemisphere.

In FIG. 1, a system 10 includes the Earth 12 and a spacecraft or artificial satellite 14. Spacecraft 14 carries an antenna 16 according to an aspect of the invention. Spacecraft 14 orbits Earth at a distance of about 36,000 km from the Earth's surface 12*s*. As seen from the spacecraft 14, Earth appears as a disk having a diameter subtending about 18°. Antenna 16 provides a "hemispherical" coverage antenna beam 18 which subtends the hemisphere of Earth facing the spacecraft. In a geosynchronous orbit, the same hemisphere will always face the spacecraft. The term "hemispherical" may not be exactly accurate, because signal coverage on the horizon as seen from the spacecraft may not correspond with the theoretical coverage because of local topology. In general, the term "hemispherical" relates to coverage to the horizon, except as perturbed by local conditions.

The disk of Earth 12 as seen from the spacecraft 14 of FIG. 1 subtends an angle of about 18°, so the antenna beam of FIG. 1 is also illustrated as subtending an angle of about 18°. Those skilled in the art know that, while they may be illustrated as hard-edged "objects" the electromagnetic-propagation "beams" produced by antennas do not have clearly defined edges. In general, the coverage of an antenna beam is defined on the Earth's surface by contours of signal strength, with the "footprint" of an antenna beam on the Earth's surface being measured at some standard power density below the peak power density of the beam. Thus, if the peak power density were, for example, one milliwatt per square meter, the edges of the footprint of an antenna beam might be defined at the −3 dB "point" or level, corresponding to one-half milliwatt per square meter. Those skilled in the art also know that antennas are reciprocal devices, which operate in the same manner for transducing between guided and unguided (radiated) electromagnetic radiation, and which have the same characteristics in both transmitting and receiving modes of operation. In particular, the radiation pattern or relative transduction response, measured as a function of solid angle away from an "axis" of the antenna, is the same in both transmitting and receiving modes. This transduction response is normally defined in terms of either the "directivity" or the "gain", where the directivity represents the theoretical gain derived from the radiation pattern, without taking into account losses and imperfections. Thus, while a transmitting antenna forms a "beam" which is conceptually plausible, the "beam" of a receiving antenna is difficult to imagine, but is well understood in the art. For historic reasons, the guided-wave port of an antenna is termed a "feed" port regardless of whether the antenna is operated in a transmitting or receiving mode of operation. Thus, the antenna beam 18 of FIG. 1 is a conventional representation of a concept, rather than a physically determinable thing.

According to an aspect of the invention, the Earth-coverage antenna beam 18, which subtends the disk of the earth and is circularly symmetric, insofar as possible, about a beam axis 8, has greater gain at angles of about 9° from axis 8 than it has on the beam center or axis, as suggested by the greater distance of the portions of the antenna beam or pattern 18 in the 9°-from-axis direction. This is accomplished in the context of a reflector-type antenna by appropriately shaping the reflector surface in conjunction with the shaping of the "illumination" of the reflector, corresponding to shaping the "beam" of a reflector-feed antenna, to provide the appropriate coverage. The shaping of the feed beam and of the reflector surface provides the desired 15 dB or so of directivity on beam axis 8, and the eighteen dB or so of directivity which is required on the horizon or at about ±9° from the beam axis.

Figure 2A:
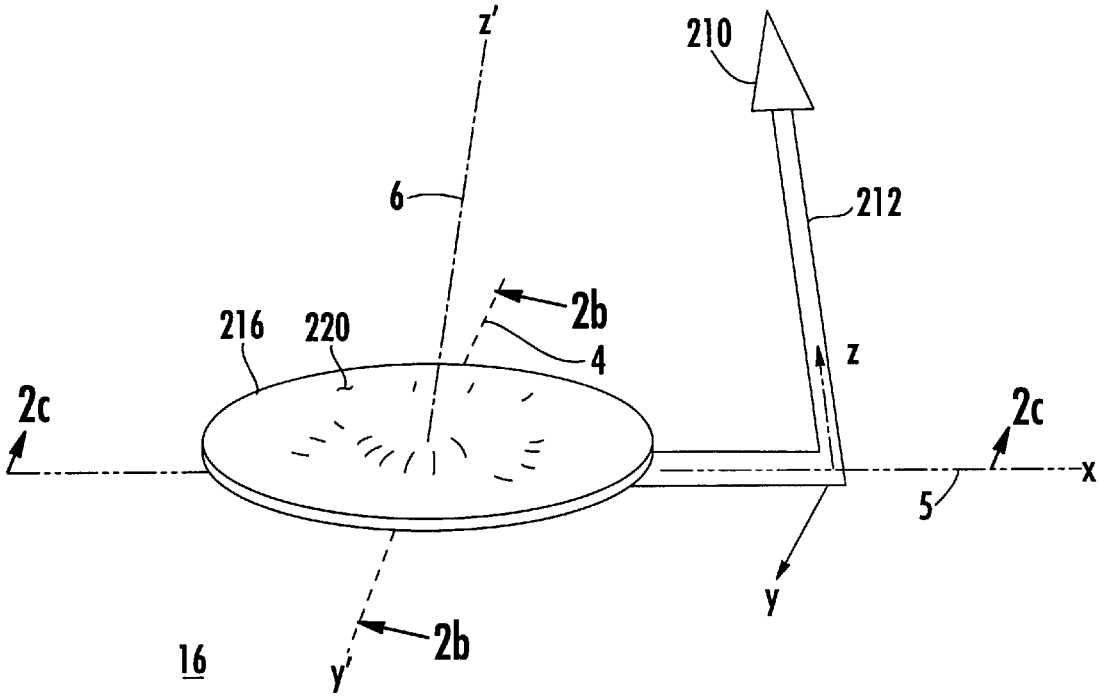
FIG. 2*a* is a simplified perspective or isometric view of a circular reflector centered on x, y', and z' coordinate axes.

More particularly, FIG. 2*a* is a simplified representation of a reflector antenna according to an aspect of the invention.

In FIG. 2*a*, antenna 16 includes a shaped reflector 216 fed by an offset feed antenna illustrated as 210, which is supported relative to the reflector 216 by means of a support structure 212. The underlying parabolic reflector which was the starting point or basis for shaped reflector 216 was based on an xyz coordinate system, while the shaped reflector represents only part of the underlying parabolic reflector, and so has its center at an offset location defined by an xy'z' coordinate system. The support structure 212 places the feed antenna 210 so that its physical center or electrical phase center lies in an xz plane which includes reflector antenna 216 z' axis 6 and a x axis or centerline 5 of reflector 216, which axis 5 is orthogonal to y' reflector axis or centerline 4. Within this plane, feed antenna 210 can lie as illustrated away from axis 6, or it may lie on axis 6.

Figure 2C:
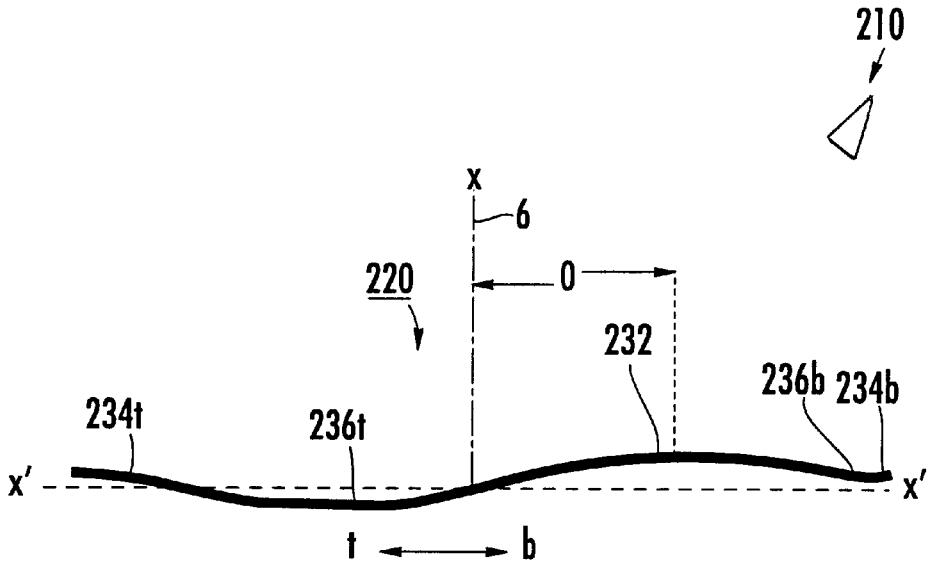
FIG. 2*c* is a cross-sectional view of the surface contour of the reflector of FIG. 2*a* looking in the direction of section lines 2*c*—2*c* and showing the off-center location of the feed antenna in the view.
Figure 2B:
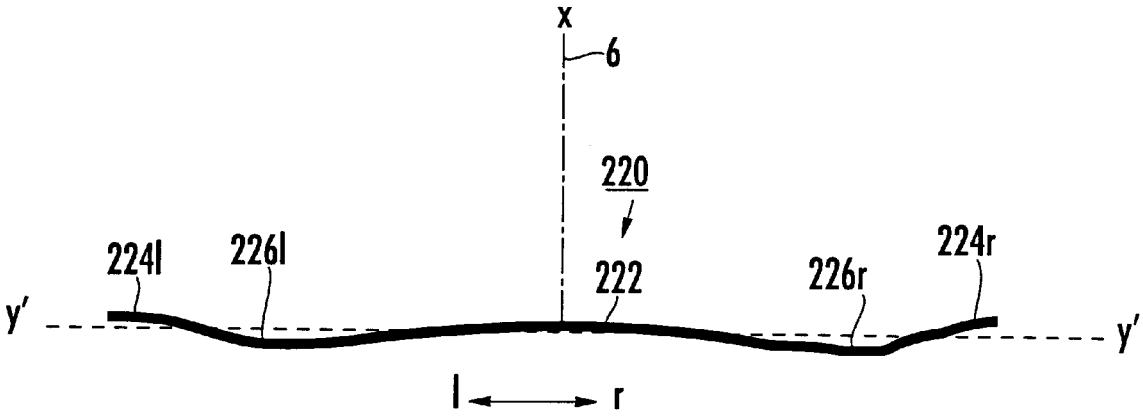
FIG. 2*b* is a cross-sectional view of the surface contour of the reflector of FIG. 2*a* looking in he direction of section lines 2*b*—2*b* showing the centered location of the feed antenna in the view.

FIG. 2*b* is a representation of the surface contour or cross-section 220 of the reflector 216 of FIG. 2*a*, looking in the direction 2*b*—2*b* of FIG. 2*a*. In FIG. 2*b*, the cross-sectional contour 220 is accompanied by a representation of feed 210, to illustrate that the feed is centered on the reflector surface as seen in the view of FIG. 2*b*. As illustrated in FIG. 2*b*, the central portion 222 of reflector surface 220, nearest reflector axis 6, is convex as seen from the feed antenna 210 side. The right and left edge portions 224*r* and 224*l*, respectively, of the reflector surface 220 are also convex as seen from the feed side of the surface. A concave portion 226*r* connects convex edge portion 224*r* with central convex portion 222, and a further concave portion 226*l* connects convex edge portion 224*l* and central convex portion 222.

If feed antenna 210 of FIG. 2*a* were coincident with reflector axis 6, the desired surface contour of reflector 216 of FIG. 2*a* would, in principle, be identical to contour 220 of FIG. 2*b*. However, to avoid blockage of the reflected beam (18 of FIG. 1), the feed antenna is offset away from the reflector axis 6, as illustrated in FIG. 2*c*. In FIG. 2*c*, the surface contour 230 represents the surface contour or cross-section of the reflector 216 of FIG. 2*a* looking in the direction of section lines 2*c*—2*c*. In FIG. 2*c*, the directions are termed "top" (t) and "bottom" (b), recognizing that such terminology is arbitrary, and has no relationship to space, or proper definition in space, but simply suggesting that the directions t and b are orthogonal to r and l of FIG. 2*b*. The top and bottom of the surface 220 of reflector 216 of FIG. 2*c* are designated 234*t* and 234*d*, and are convex as seen from the feed side of the surface 220. Another, more central, convex portion is designated 232, and its peak projection can be seen to be offset by distance 0 away from reflector axis 6, in the same direction as feed 210 is offset. A concave portion designated 236*t* connects to the convex top portion 234*t* on the one side and to the more central convex portion 232, and a further concave portion designated 236*d* connects to the convex bottom portion 234*d* on the one side and to more central convex portion 232 on the other side.

Reflectors of the type illustrated in FIGS. 2*a*, 2*b*, and 2*c* are termed "diverging" because the result of simple ray analysis, at least when applied to the underlying parabolic reflector, indicates that rays originating from the focus of the reflector are reflected or deviated outwardly, away from the axis of the reflector, by comparison with rays extending parallel to the reflector axis as in the case of a prime-focus parabolic reflector.

Figure 3A:
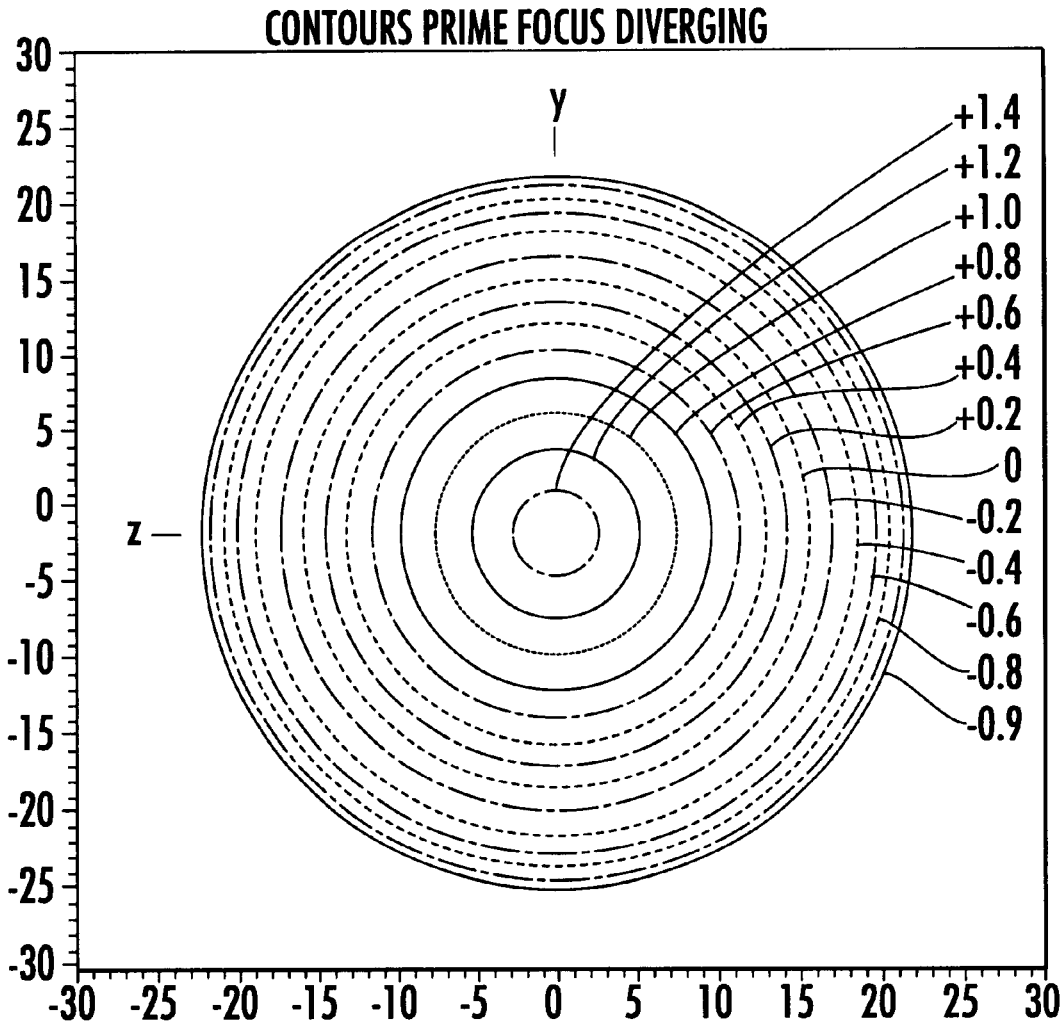
FIG. 3*a* is a plot of calculated surface contours of a shaped-reflector antenna relative to those of a parabola according to an embodiment of the invention, for the case of an underlying diverging prime-focus parabolic reflector.
Figure 3B:
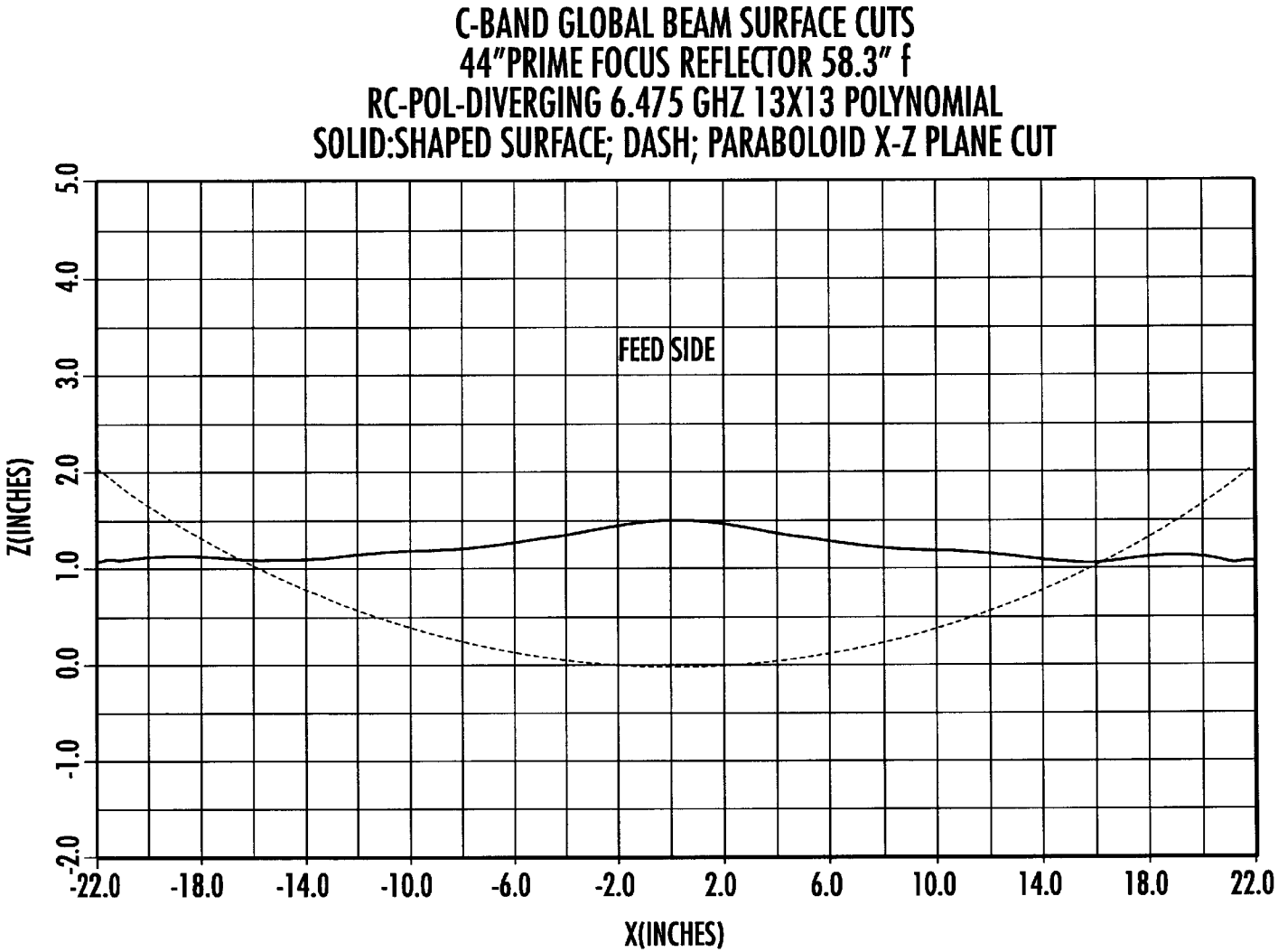
FIG. 3*b* is a plot of the surface contours of the reflector antenna of FIG. 3*a* in the xz plane.
Figure 3C:
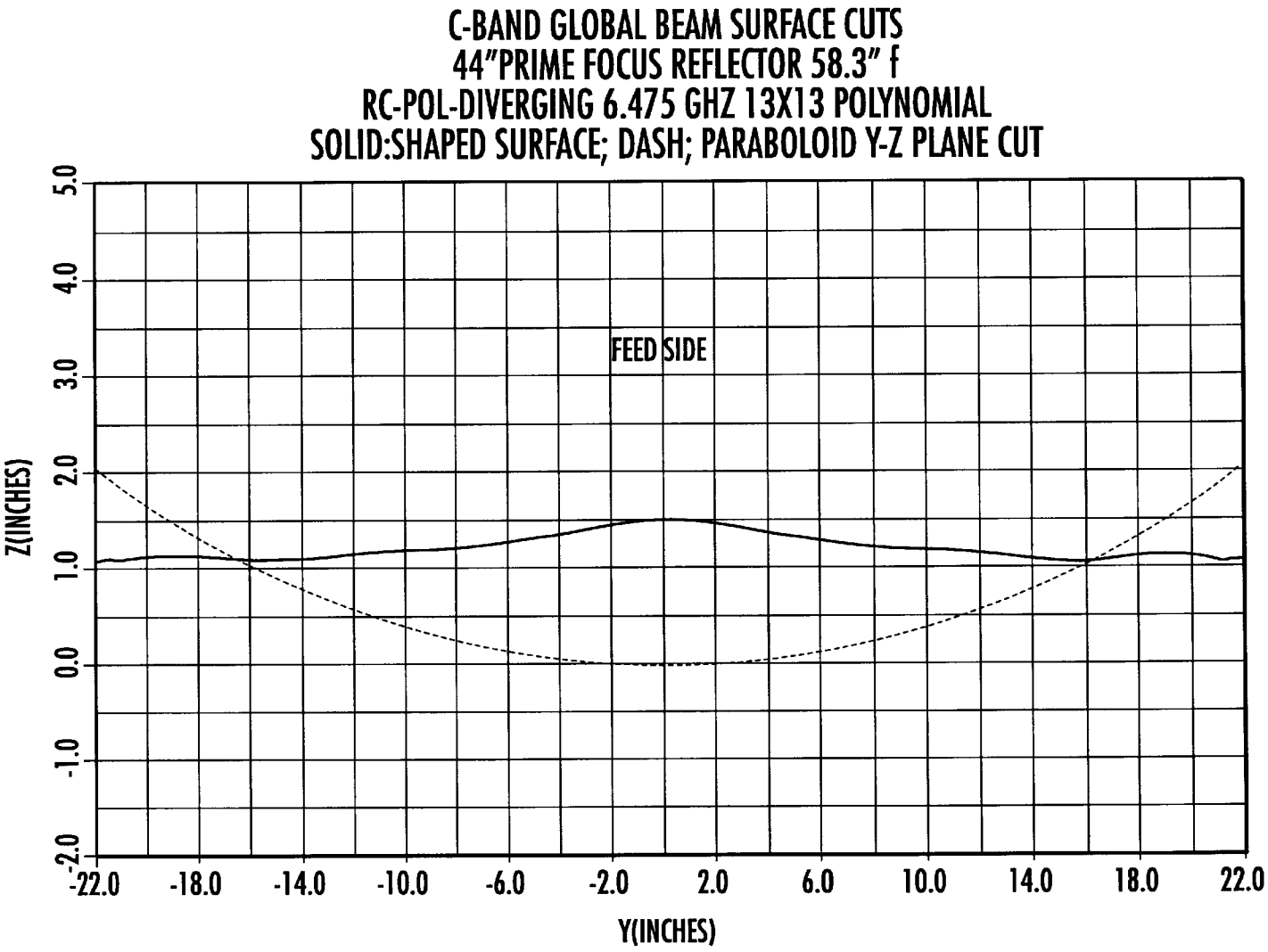
FIG. 3*c* is a plot of the surface contours of the reflector antenna of FIG. 3*a* in the yz plane.

FIG. 3*a* is a plot of surface contours relative is to an ideal parabolic surface contour for a 44-inch-diameter prime focus diverging shaped reflector with a focal length of 58.3 inches, fed at 6.475 GHz by a corrugated conical feed horn having substantially equal E and H plane beamwidths exhibiting a left circularly polarized (also known as left-hand or LHCP) radiation pattern which is −27.5 dB relative to beam peak at an angle of 21.3° from the feed axis. In this context, the term "prime focus" refers to the location of the feed on the axis of symmetry of the defining parabola and the location of the reflector symmetrically disposed about the axis of symmetry. The ordinate and abscissa axes in FIG. 3*a* represent inches. The contours follow the general pattern illustrated in FIG. 2*b*, and are essentially circular, as one would expect for a prime-focus feed antenna. More particularly, the contour pattern of FIG. 3*a* includes a contour designated 0, which corresponds to a surface contour which is at the same position as the surface of a parabolic reflector having the same diameter and focus. The center-most contour is illustrated as being +1.4, corresponding to a contour which is raised 1.4 inches above the surface of the corresponding parabolic reflector, where the term "raised" indicates a deviation in the general direction of the feed. The computer program which made the calculations was programmed to mark the +1.6-inch contours, but none appear in the plot, thereby indicating that the center point of the reflector antenna according to this embodiment of the invention does not reach +1.6 inches above the surface of the corresponding parabolic reflector. The positive-magnitude contours decrease from the +1.4" contour to +1.2", +1", +0.8", +0.6", +0.4", and +0.2" with increasing distance from the center of the reflector surface, finally arriving at the 0.0" contour. The contours continue to decrease into negative values, progressing from the 0.0" contour to −0.2", −0.4", −0.8" at increasing diameters from the center of the reflector, and finally arriving at −0.91" near the physical edge of the reflector. In FIG. 3*b*, the dash-line plot represents the prime-focus diverging parabolic reflector surface contour in the xz plane for a 44" reflector at 6.475 GHz, and the solid-line plot represents the corresponding shaped reflector surface contour to provide the desired radiation pattern. In FIG. 3*c*, the dash line is the underlying parabolic reflector surface contour, and the solid line is the corresponding shaped reflector plot for the yz plane.

Figure 3D:
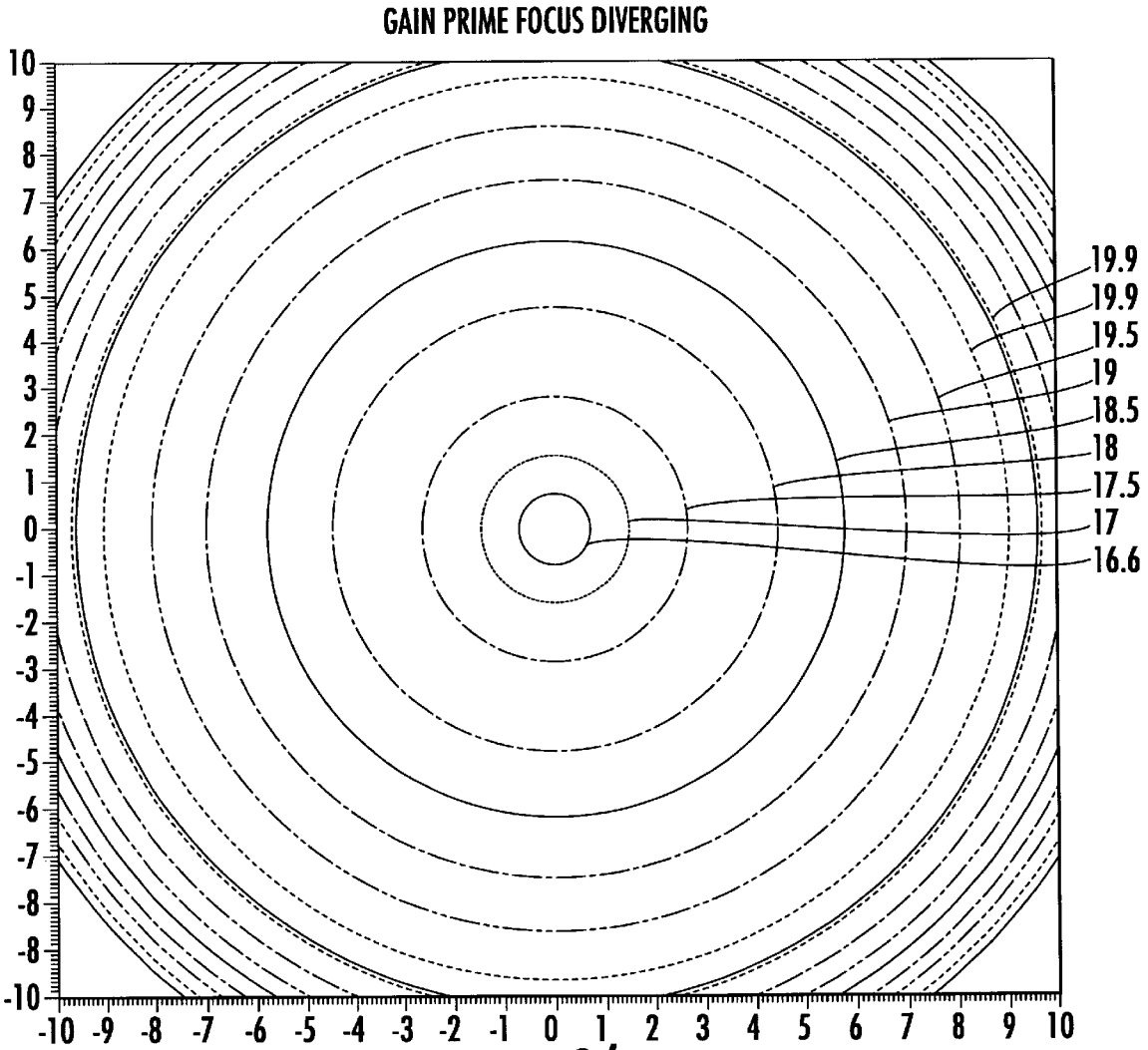
FIG. 3*d* is a calculated plot of far-field radiation or directivity contours of the reflector antenna of FIG. 3*a*.
Figure 3E:
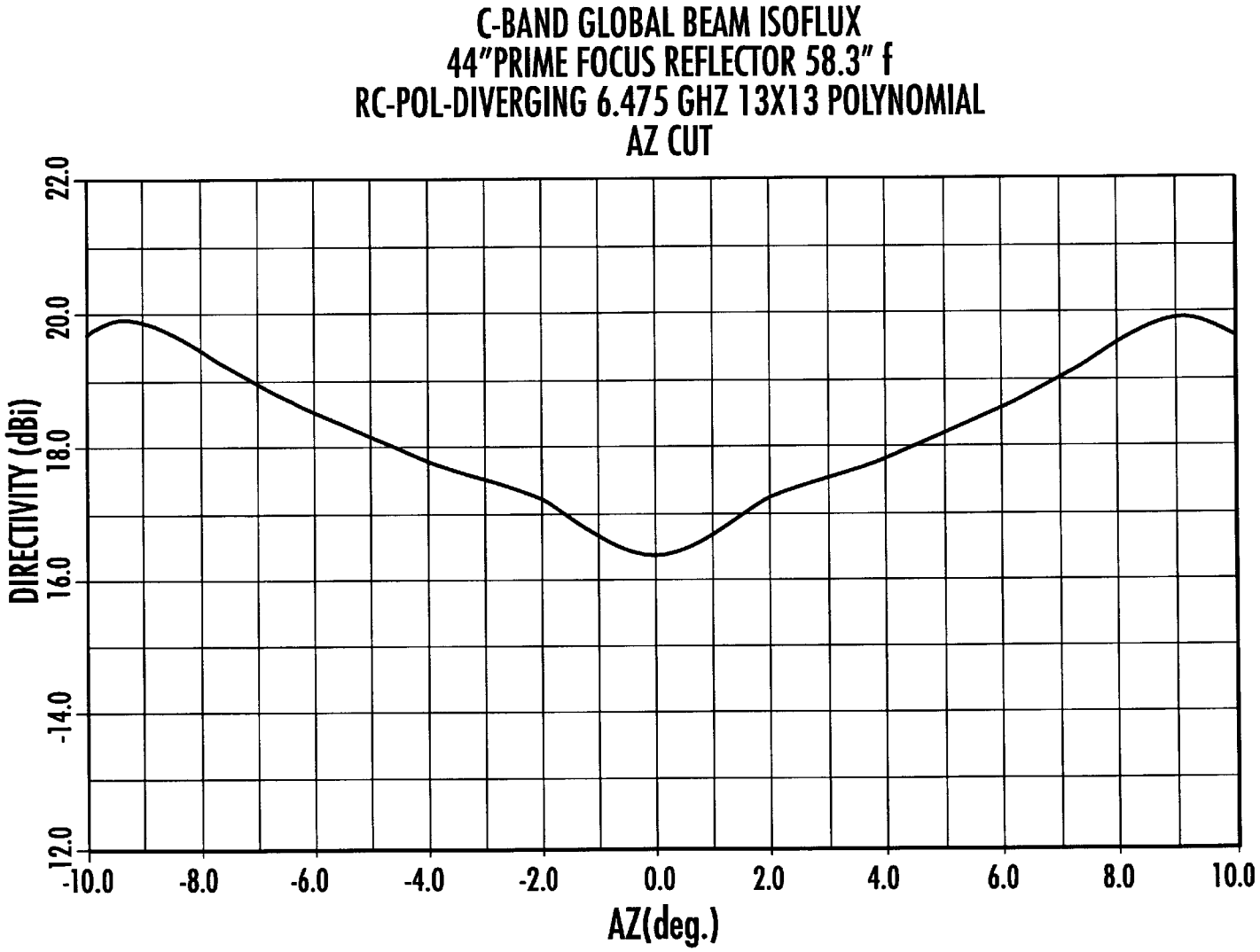
FIG. 3*e* is a calculated azimuth plot of the far-field radiation pattern of the reflector antenna of FIG. 3*a*.
Figure 3F:
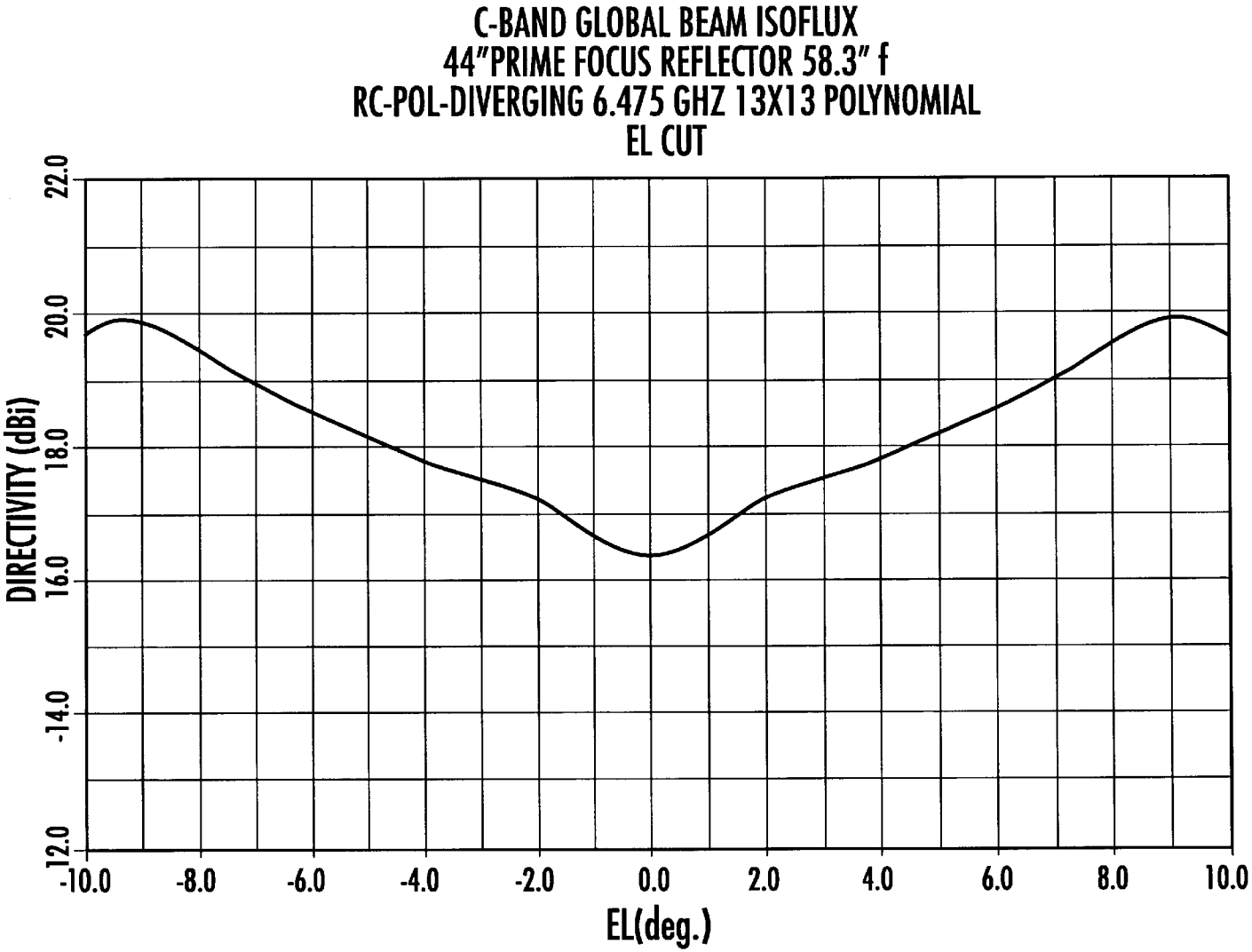
FIG. 3*f* is a calculated elevation plot of the far-field radiation pattern of the reflector antenna of FIG. 3*a;*

FIG. 3*d* plots the directivity provided by the surface contours associated with FIG. 3*a* when fed by the above-mentioned corrugated conical horn. In FIG. 3*d*, the on-axis directivity (the directivity at 0°, 0°) is in the vicinity of 16 dB, rising more or less monotonically toward with increasing angle within the beam to about 8.5°. Toward the edge of the beam, two adjacent 19.9 dB contours appear side-by-side. These two contours, without an intermediate 20 dB contour, indicate that the directivity rose to a peak value greater than 19.9 dB at a contour lying between the two 19.9 dB contours. FIGS. 3*e* and 3*f* are plots of the radiation pattern of the reflector antenna in azimuth and elevation, respectively. Since the reflector is essentially circularly symmetric and is fed on-axis by a symmetric feed, it would be expected that the plots of FIGS. 3*e* and 3*f* would be identical, and they are. In the plot of FIG. 3*e*, the on-axis (corresponding to the nadir) directivity is seen to be 16.5 dB, and the directivity at ±9° (the horizon) is almost 20 dB, which provides a directivity difference of about 3.5 dB. The plots of FIGS. 3*a*, 3*b*, 3*c*, 3*d*, and 3*e*, and those of FIGS. 4*a* through (–) 4*f*, 6*a*–6*f*, and 7*a*–7*f* were made by computer simulation using minimum-maximum optimization of a set of Zernike polynomial equations which define the shape of the surface. Other types of polynomials, such as cubic spline equations, could be used. While the calculation could be performed manually, the use of a computer is less tedious. Such optimizations are well known in the antenna arts generally, and require no further explanation. In general, the surface-shape solutions provided by such optimizations are not unique, in that many possible surface contours can provide the desired radiation pattern. The same polynomial set may give rise to different surface contour results, depending upon the solution converged upon; some solutions may be radially symmetric near the edge of the reflector, others may provide a concave portion on one side of the reflector and a corresponding convex portion on the diametrically opposite side; both can provide the same far-field performance. The polynomial equations selected to define the surface contour are complex, and tend not to be "well behaved" near the mathematical boundary, corresponding to the edge of the reflector. The polynomials selected for optimization in the illustrated examples were 13×13, but may be of higher or lower order, depending upon the "exactness" of the desired solution. In such a simulation, the diameter and the focal length of the underlying parabolic reflector are specified, and the parameters to be optimized are selected. The computer then modifies the shape of the parabola to produce a shaped reflector in which the surface contours are optimized to produce a close approximation of the desired parameters. In the case of this invention, the parameters to be optimized by shaping the reflector are selected to be the directivity, directive gain or gain to provide substantially equal signal energy or field strength over the entirety of the Earth's surface.

Figure 4A:
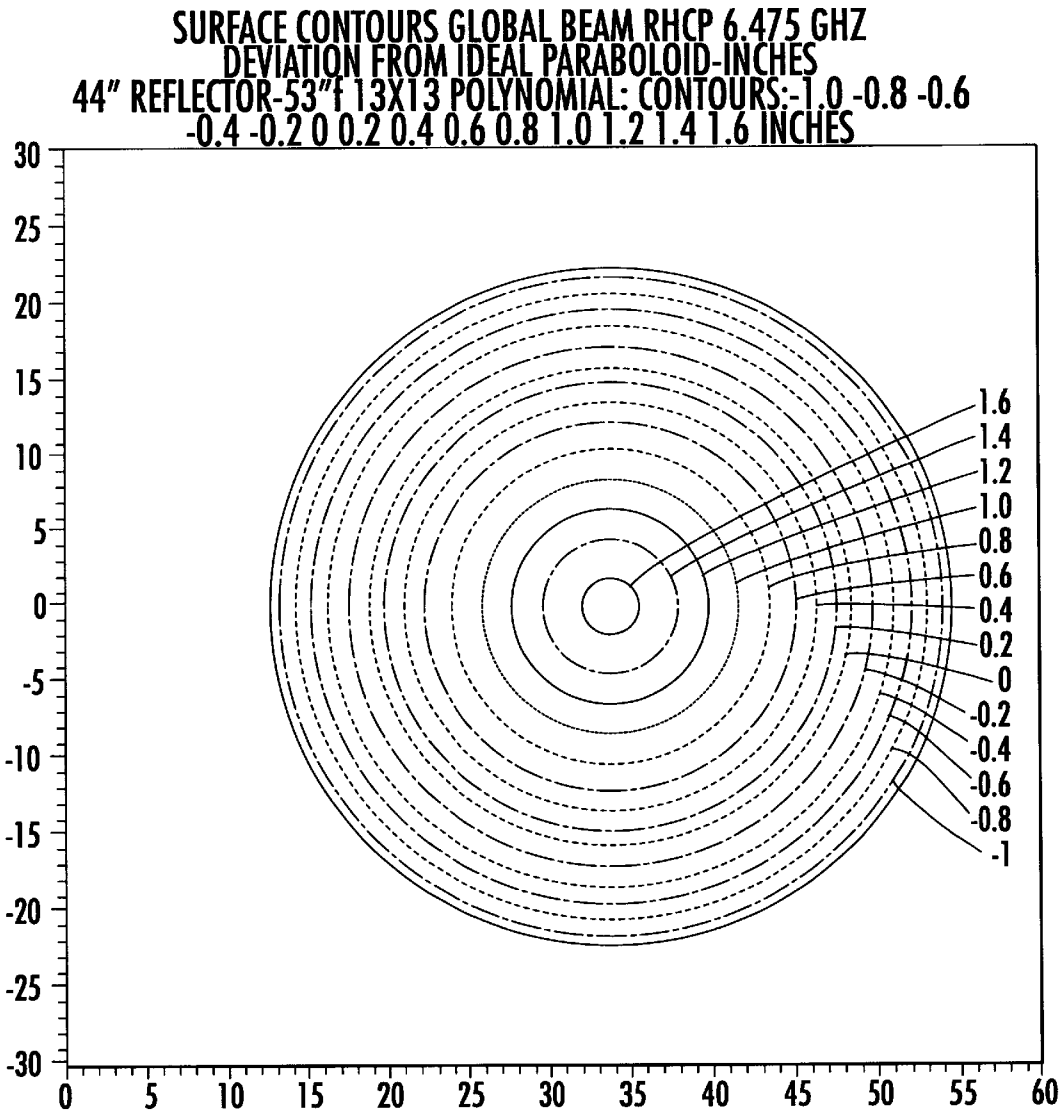
FIG. 4*a* is a plot of calculated surface contours of a shaped-reflector antenna relative to those of a parabola according to an embodiment of the invention for the case of an underlying diverging offset-feed parabolic reflector.

FIG. 4*a* is a plot of surface contours relative to a Parabolic surface contour for a 44-inch-diameter offset-feed diverging reflector with a focal length of 58.3 inches, fed at 6.475 GHz by a corrugated conical feed horn identical to that described in conjunction with FIG. 3*a*. The axes in FIG. 4*a* represent inches. The contours of FIG. 4*a* follow the general pattern illustrated in FIG. 2*b*, but are less circular than those of FIG. 3*a*, as one would expect for an offset-feed reflector antenna. More particularly, the contour pattern of FIG. 4*a* includes a contour designated 0, which corresponds to a surface contour which is at the same position as the surface of a parabolic reflector having the same diameter and focal length. The center-most contour is illustrated as being +1.6, corresponding to a contour which is raised 1.6 inches above the surface of the corresponding parabolic reflector, where the term "raised" indicates a deviation in the general direction of the feed. The computer program which made the calculations was programmed to mark the +1.8-inch contours, but none appear in the plot, thereby indicating that the center point of the reflector antenna according to this embodiment of the invention does not reach 1.8 inches above the surface of the corresponding, parabolic reflector. The positive-magnitude contours decrease from the +1.6" contour to +1.4", +1.2", +1", +0.8", +0.6", +0.4", and +0.2" with increasing distance from the center of the reflector surface, finally arriving at the 0.0" contour. The contours continue to decrease into negative values, progressing from the 0.0" contour to −0.2", −0.4", −0.8" at increasing diameters from the center of the reflector, and finally arriving at −1.0" near the physical edge of the reflector.

Figure 4B:
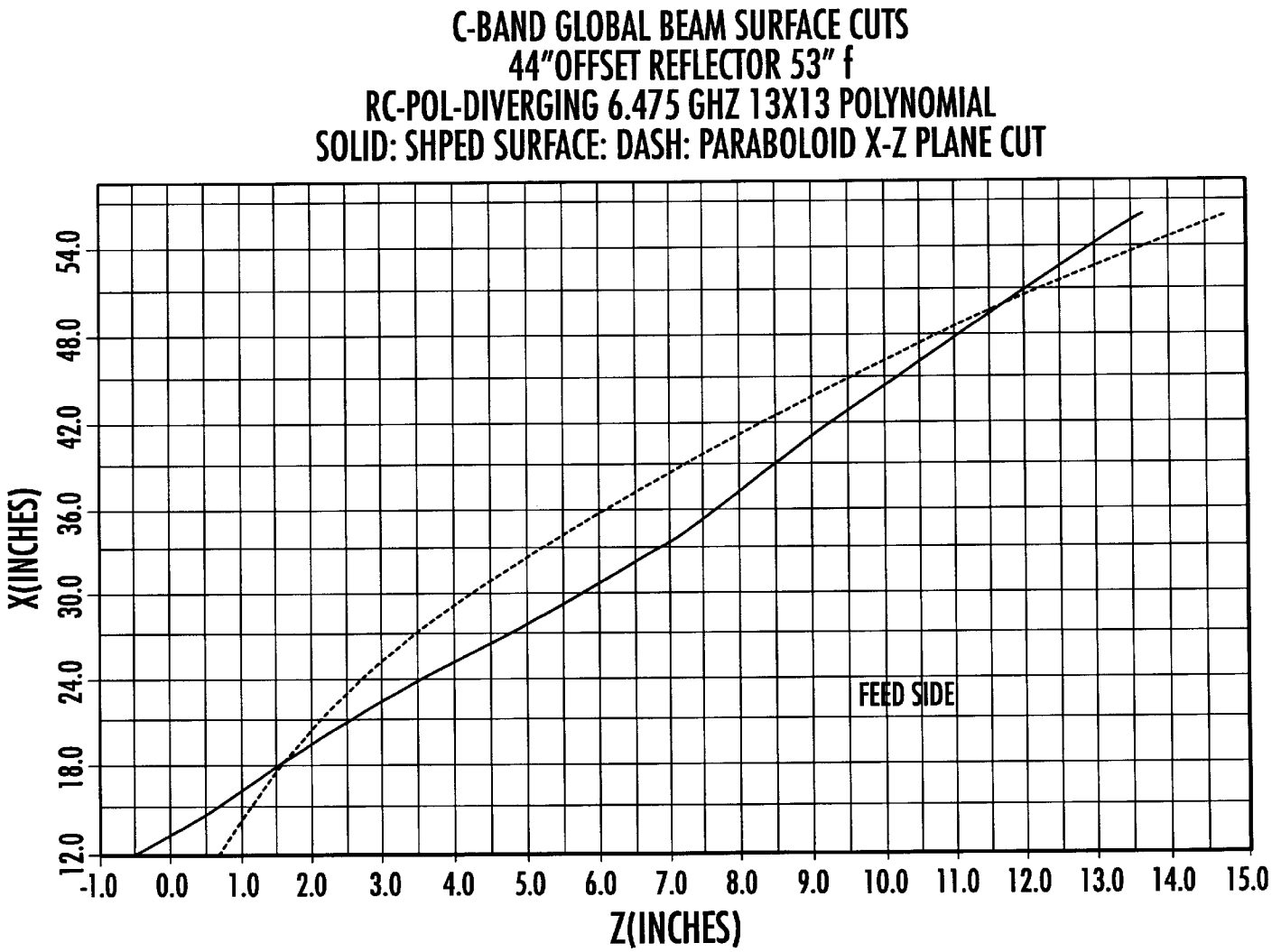
FIGS. 4*b* and 4*c* are plots in the xz and yz planes, respectively, of the surface contours of the reflector antenna of FIG. 4*a*.
Figure 4C:
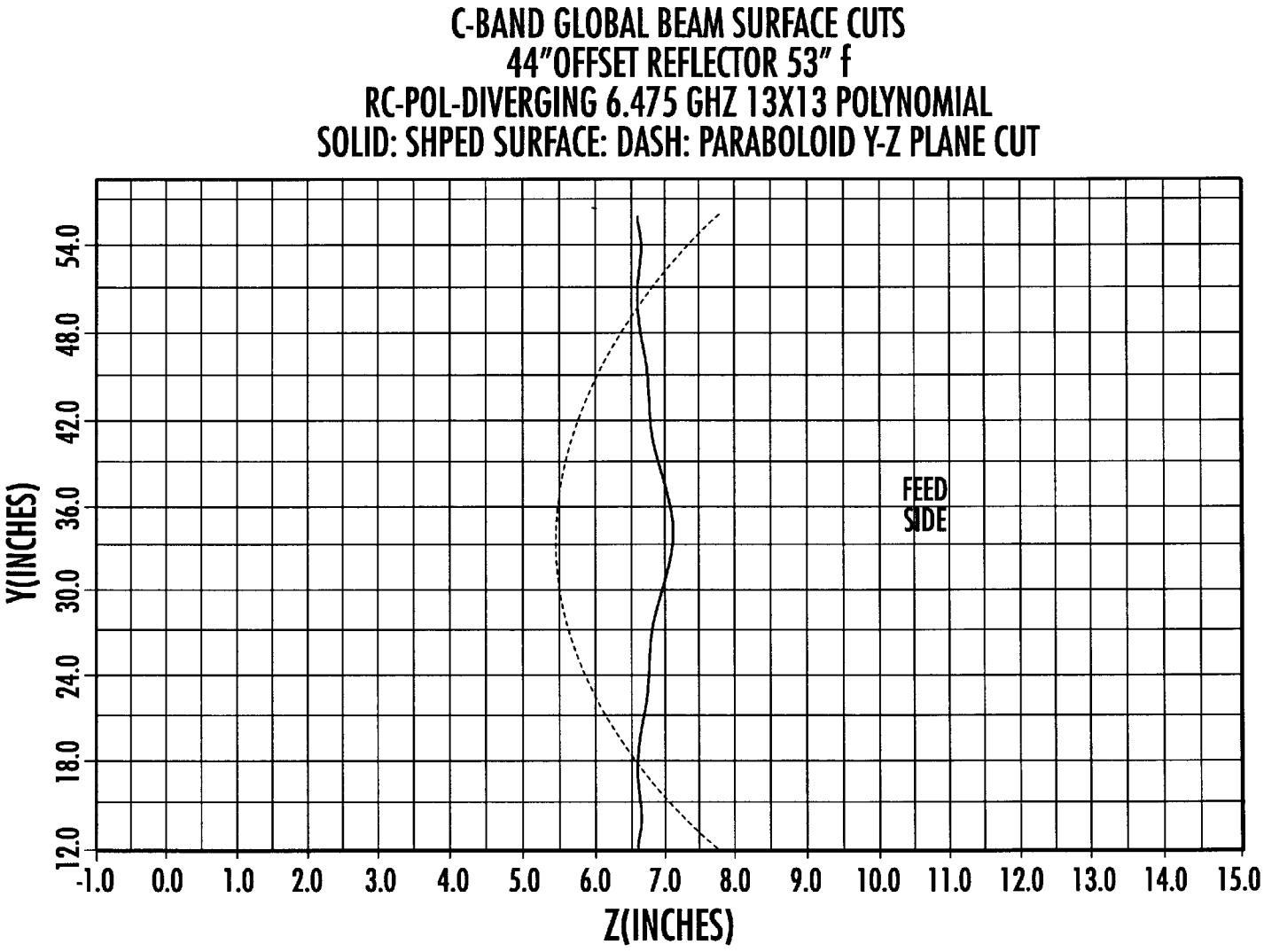

In FIGS. 4*b* and 4*c*, the dash-line plots represent the surface contours of the underlying offset parabolic reflector antenna of FIG. 4*a* in the xz and yz planes, respectively, and the solid-line plots represent the surface contour of the shaped reflector of FIG. 4*a*. In FIG. 4*b*, the center of the shaped reflector surface, namely that portion of the solid line occurring at about the 7" marking on the abscissa, has a convex shape as seen from the feed side. Another rather shallow convex region appears near the shaped reflector edges, at about 0.5" and 12" in FIG. 4*b*, and a similarly shallow concave region lies between the central and edge convex regions, at about 1.5" and 11" along the abscissa. The convex central region centered at about 33" along the ordinate axis is apparent in the solid-line shaped reflector contour of FIG. 4*c*, and the edge convex region appears at about 14 or 15" and at about 53" along the ordinate axis. A concave region as seen from the feed side appears between the central and edge convex regions, at about 18" and 50."

Figure 4D:
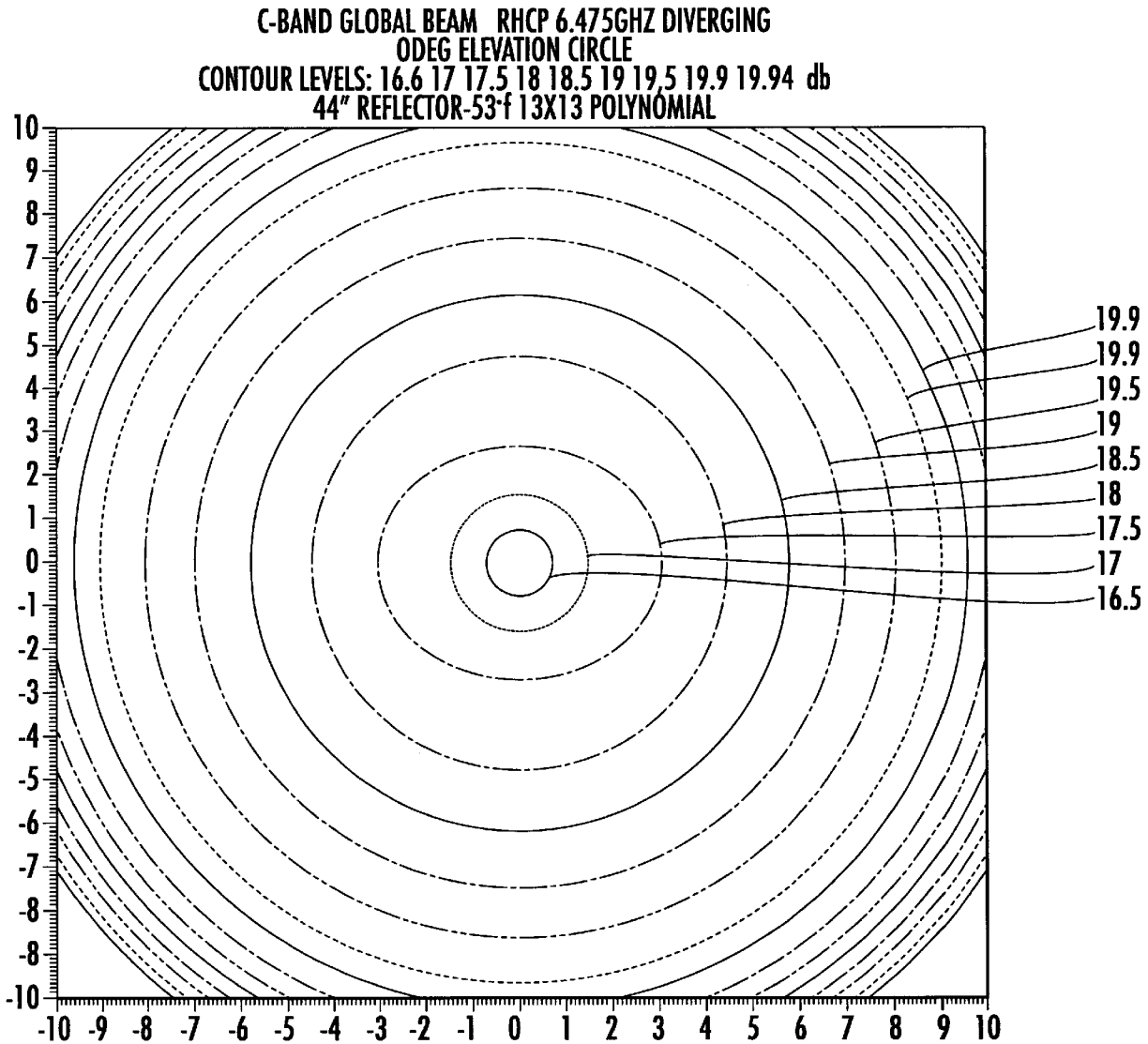
FIG. 4*d* is a calculated plot of far-field radiation or directivity of the reflector antenna of FIG. 4*a*.
Figure 4E:
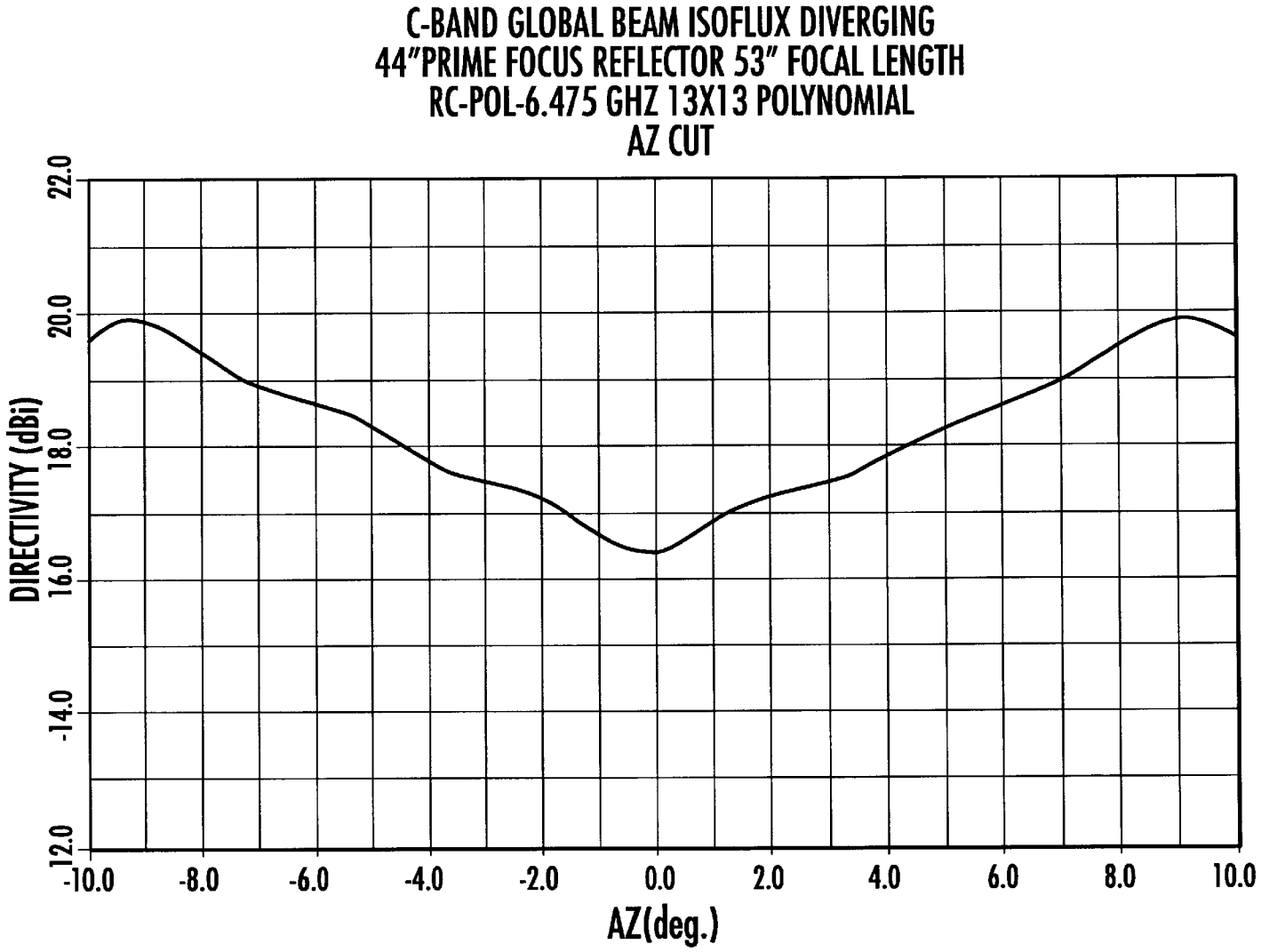
FIG. 4*e* is a calculated azimuth plot of the radiation pattern of the reflector antenna of FIG. 4*a*.
Figure 4F:
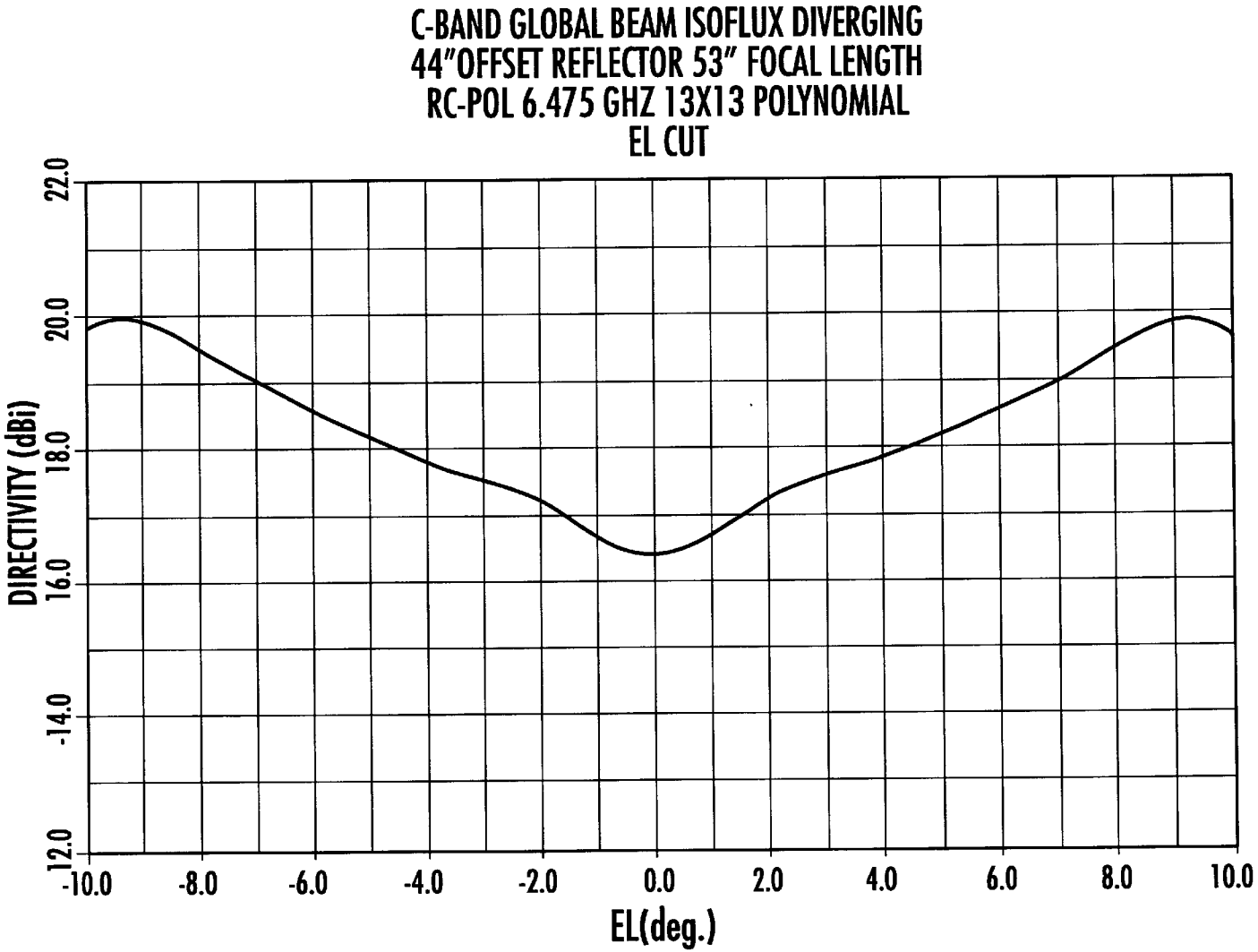
FIG. 4*f* is a calculated elevation plot of the radiation pattern of the reflector antenna of FIG. 4*a;*

FIG. 4*d* plots the directivity or theoretical gain as a function of angle provided by shaped reflector antenna with the surface contours associated with FIG. 4*a* when fed by the abovementioned corrugated conical horn. In FIG. 4*d*, the on-axis (0°, 0°) directivity is In the vicinity of 16 dB, rising more or less monotonically toward the edge (±9°) of the beam. The directivity contours of FIG. 4*d* makes the eccentricity of the reflector more evident than the physical contours of FIG. 4*a*. These eccentricities in contour are required to correct for or compensate for the offset location of the feed antenna, yet provide the desired directivity pattern. Toward the edge of the reflector, two adjacent 19.9 dB contours appear side-by-side without an intervening contour. These two 19.9 dB contours, without an intermediate 20 dB contour, indicate that the directivity rose to a peak value greater than 19.9 dB at a contour lying between the two 19.9 dB contours. FIGS. 4*e* and 4*f* are plots of the radiation pattern of the reflector antenna in azimuth and elevation, respectively. Since the reflector is not circularly symmetric and is offset-fed, it would be expected that the plots of FIGS. 4*e* and 4*f* would differ, but they are virtually identical to each other and to those of FIGS. 3*e* and 3*f*. This similarity results from the optimization of the reflector in both cases to produce the desired radiation patterns, taking the feed location and offset into account. In the plots of FIGS. 4*e* and 4*f*, the on-axis (corresponding to the nadir) directivity is seen to be 16.5 dB, and the directivity at ±9° (the horizon) is almost 20 dB. Again, this provides a directivity difference of about 3.5 dB over the radius of the Earth.

Figure 5A:
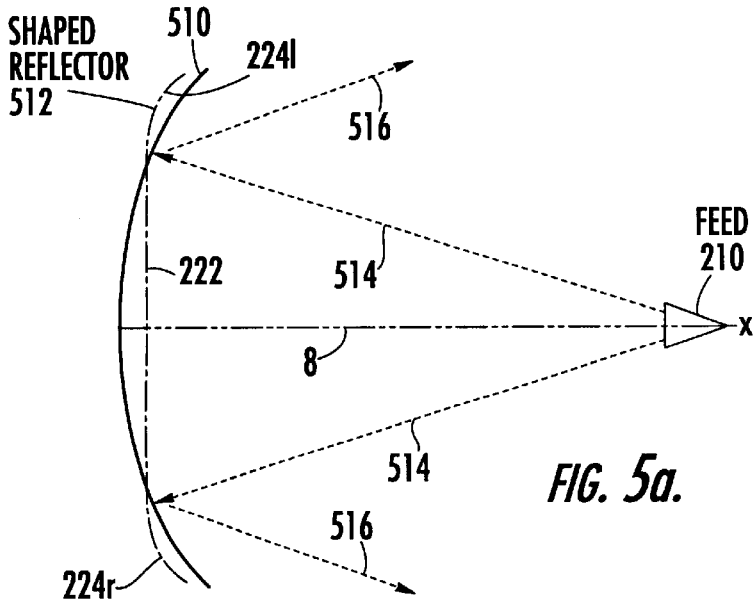
FIG. 5*a* is a simplified illustration explaining the generation of the prime-focus diverging-beam reflector.
Figure 5B:
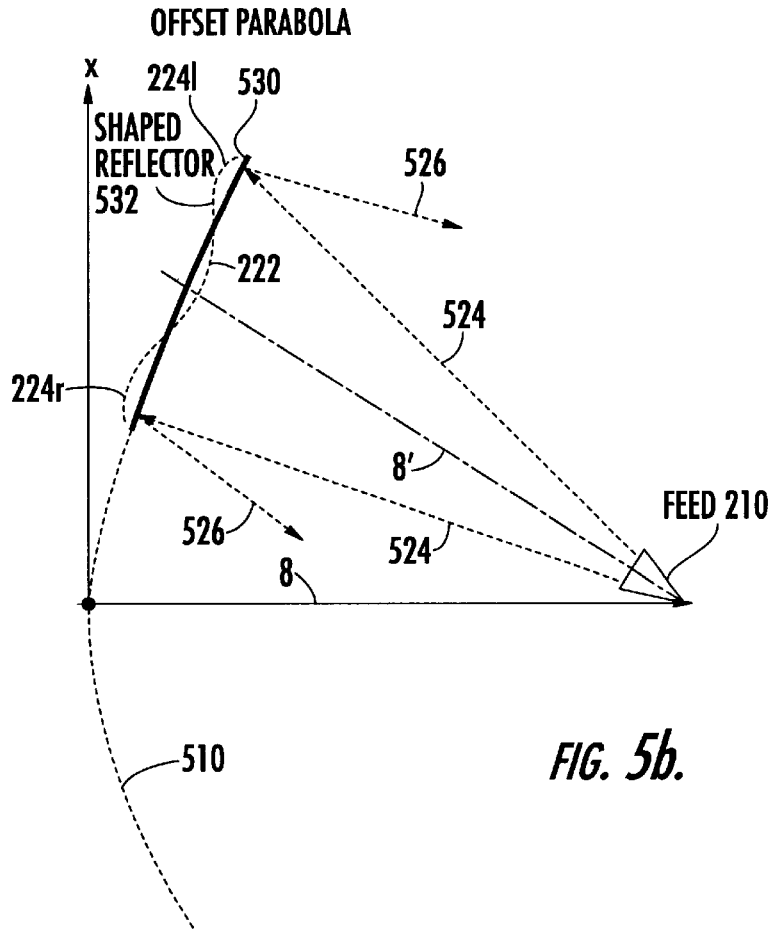
FIG. 5*b* is a simplified illustration explaining the generation of an offset-fed diverging-beam reflector.
Figure 5C:
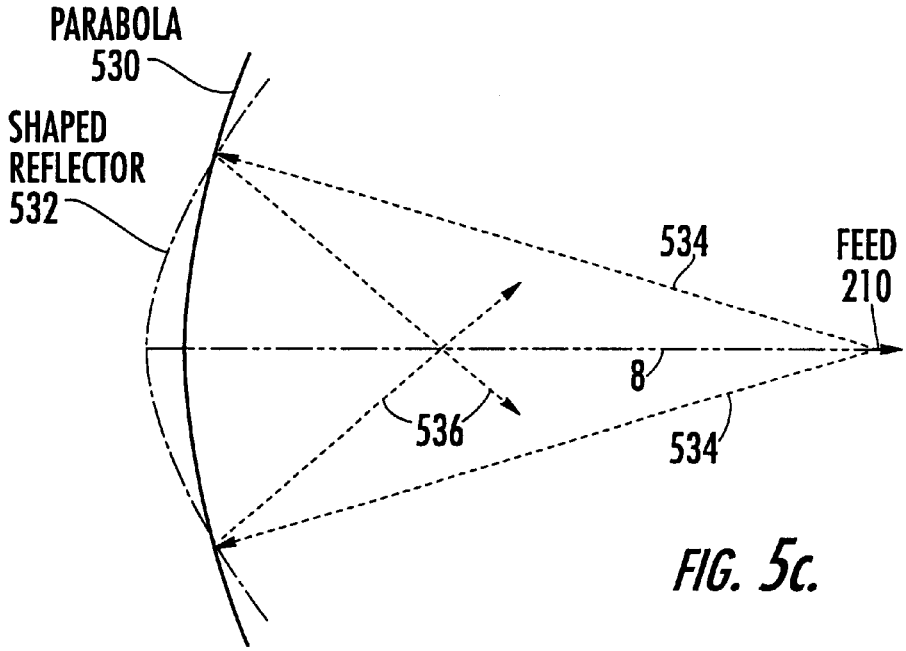
FIG. 5*c* is a simplified illustration explaining the generation of a prime-focus converging reflector.
Figure 5D:
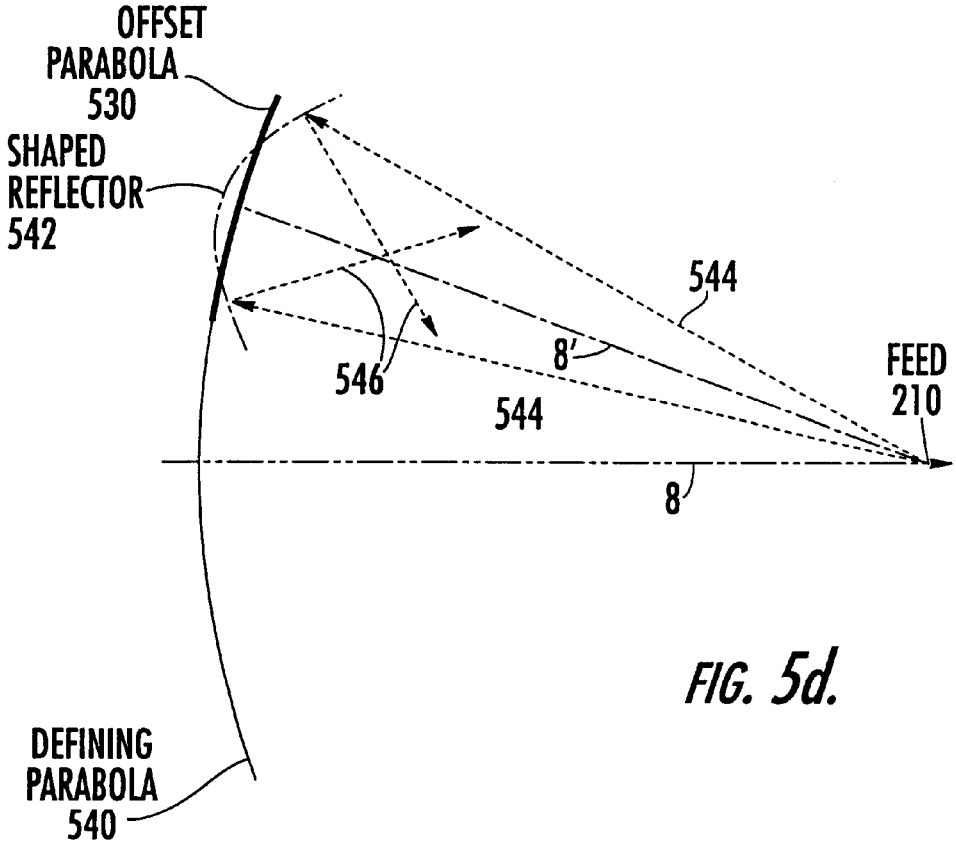
FIG. 5*d* is a simplified illustration explaining the generation of an offset-fed converging reflector.

As so far described reflector antennas according to the invention have been described as diverging reflector antennas. In FIG. 5*a*, the underlying or theoretical parabolic reflector is designated 510, its axis is 8, and the feed 210 is located at the focus of the underlying reflector 510. The underlying reflector, if a true parabola, will reflect incident rays from its focal point in a "collimated" manner, that is to say, parallel and neither converging nor diverging. The diverging shaped reflector is indicated as 512. A ray 514 propagating at a given angle from the feed 210 to the diverging reflector 512 is reflected as a ray designated as 516, in a direction which causes reflected beam 516 to diverge away from each other and from axis 8. This corresponds to the antenna described in conjunction with FIGS. 3*a*, 3*d*, 3*e*, and 3*f*. In FIG. 5*b*, the underlying or theoretical parabolic reflector is again designated 520, its axis is 8, and the feed 210 is located at the focus of the underlying reflector 520. Unlike the arrangement of FIG. 5*a*, the reflector 520 is a segment of the underlying parabola which is not symmetric about axis 8. The shaped reflector is designated as 522. A ray 524 propagating at a given angle from the feed 210 to the diverging reflector 522 in FIG. 5*b* is reflected as a ray designated as 526, in a direction which causes reflected beam 526 to diverge away from axis 8. This corresponds to the antenna described in conjunction with FIGS. 4*a*, 4*d*, 4*a* and 4*f*. In addition to such diverging reflectors, converging reflectors may be used. FIG. 5*c* represents a prime-focus converging reflector 530 centered on an axis 8, with a feed 210 at its focus. The converging shaped reflector is indicated as 532. A ray 534 leaving feed 210 at a given angle is reflected as a reflected ray 536. It will be noted that the reflected ray 535 is reflected at an angle which results in an initial approach to the axis 8. Thus, unlike the diverging arrangements such as those of FIGS. 5*a* and 5*b*, the converging arrangement of FIG. 5*c* results in "crossing" of the rays of the beams, instead of their always diverging from each other. The converging type of reflector antenna may also be applied in the case of an offset feed. In FIG. 5*d*, the offset underlying or basic parabola is designated 540, with an axis 8. The converging shaped reflector is designated 542. As in the case of FIG. 5*c*, the converging shaped reflector 542 of FIG. 5*d* reflects an incident feed ray 544 at an angle which causes the reflected ray 546 to cross the axis 8.

Figure 6A:
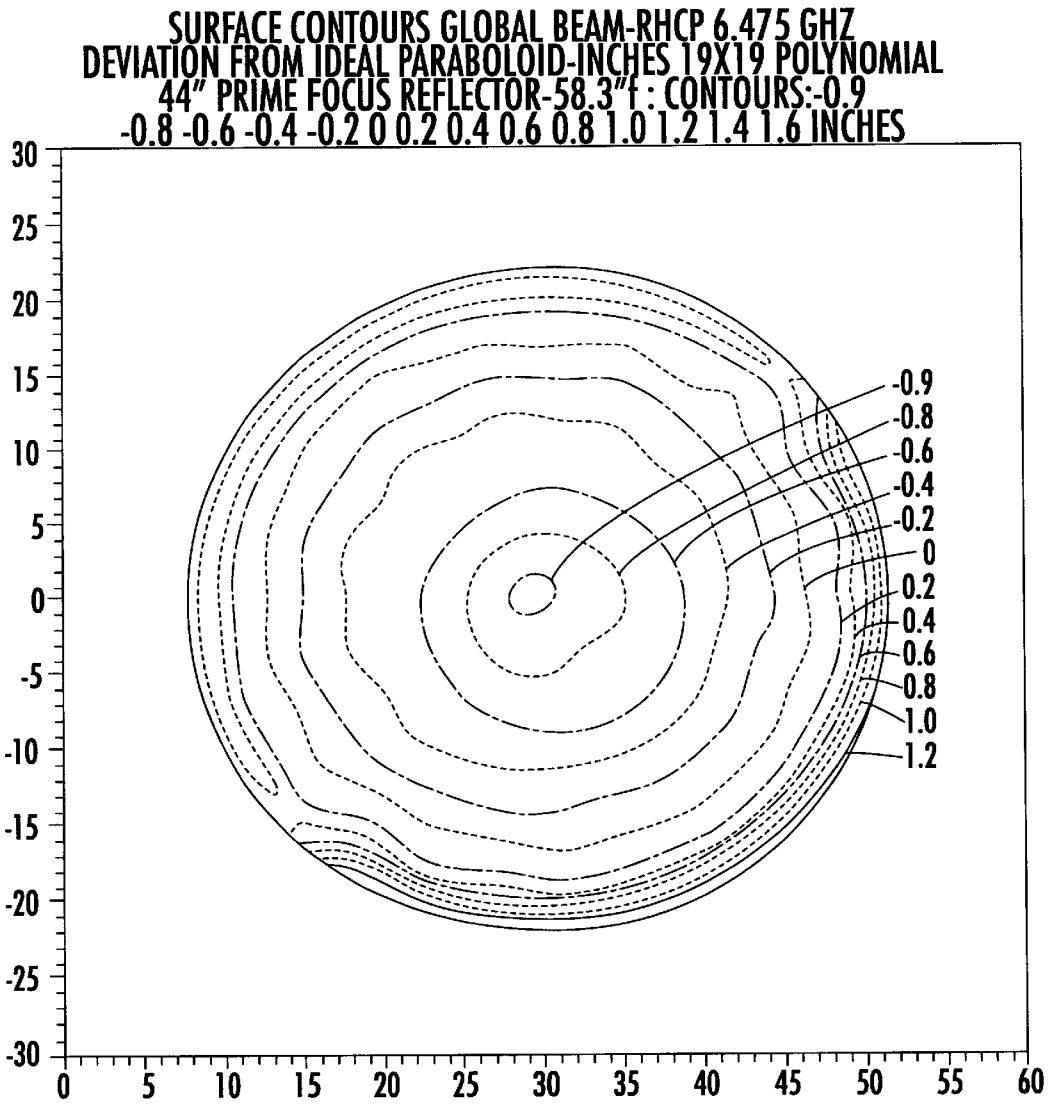
FIG. 6*a* is a plot of calculated surface contours of a shaped-reflector antenna relative to those of a parabola according to an embodiment of the invention for the case of a converging prime-focus reflector.
Figure 6B:
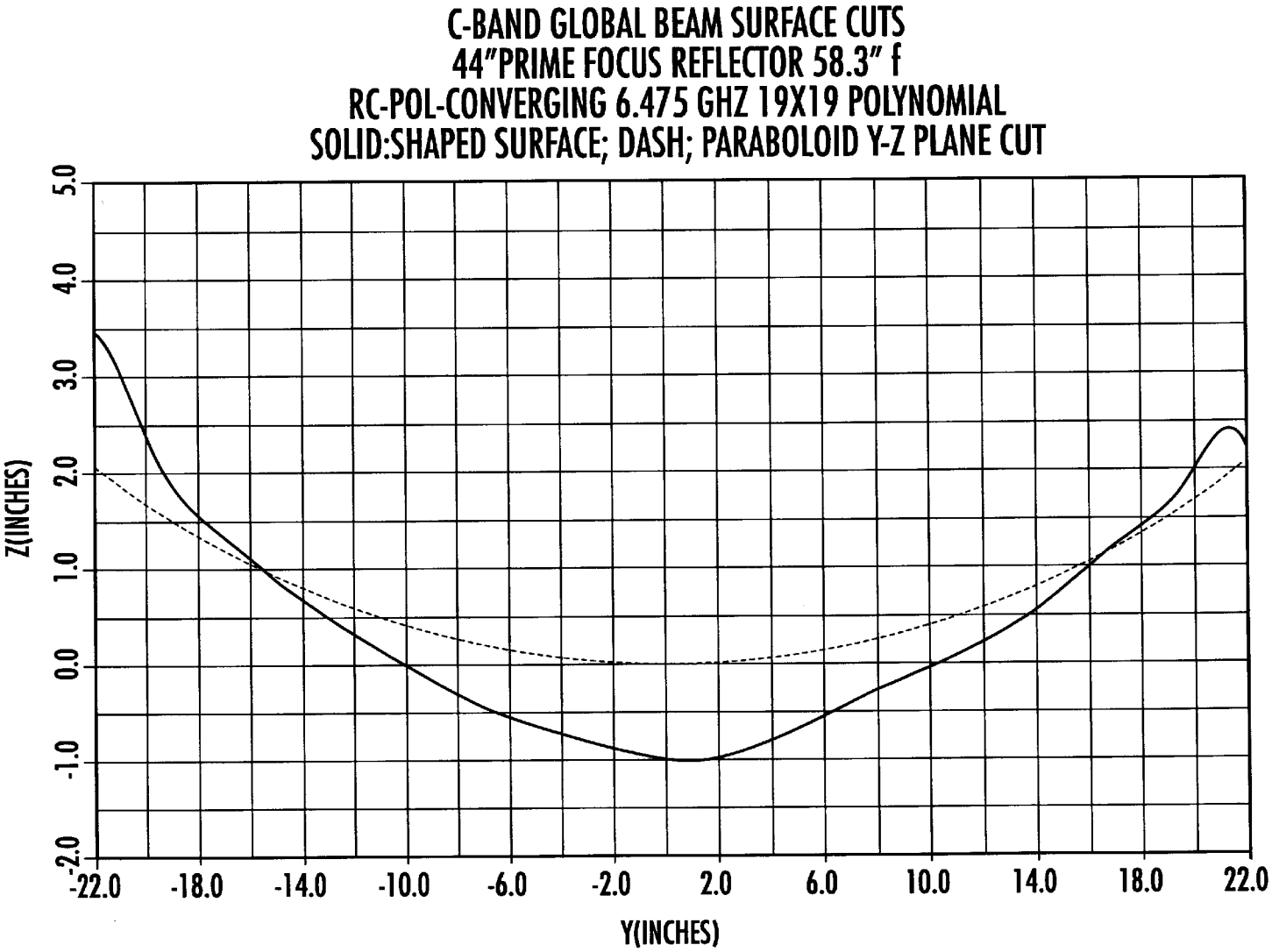
FIGS. 6*b* and 6*c* are plots of the reflector antenna of FIG. 6*a* in the xz and yz planes, respectively.
Figure 6C:
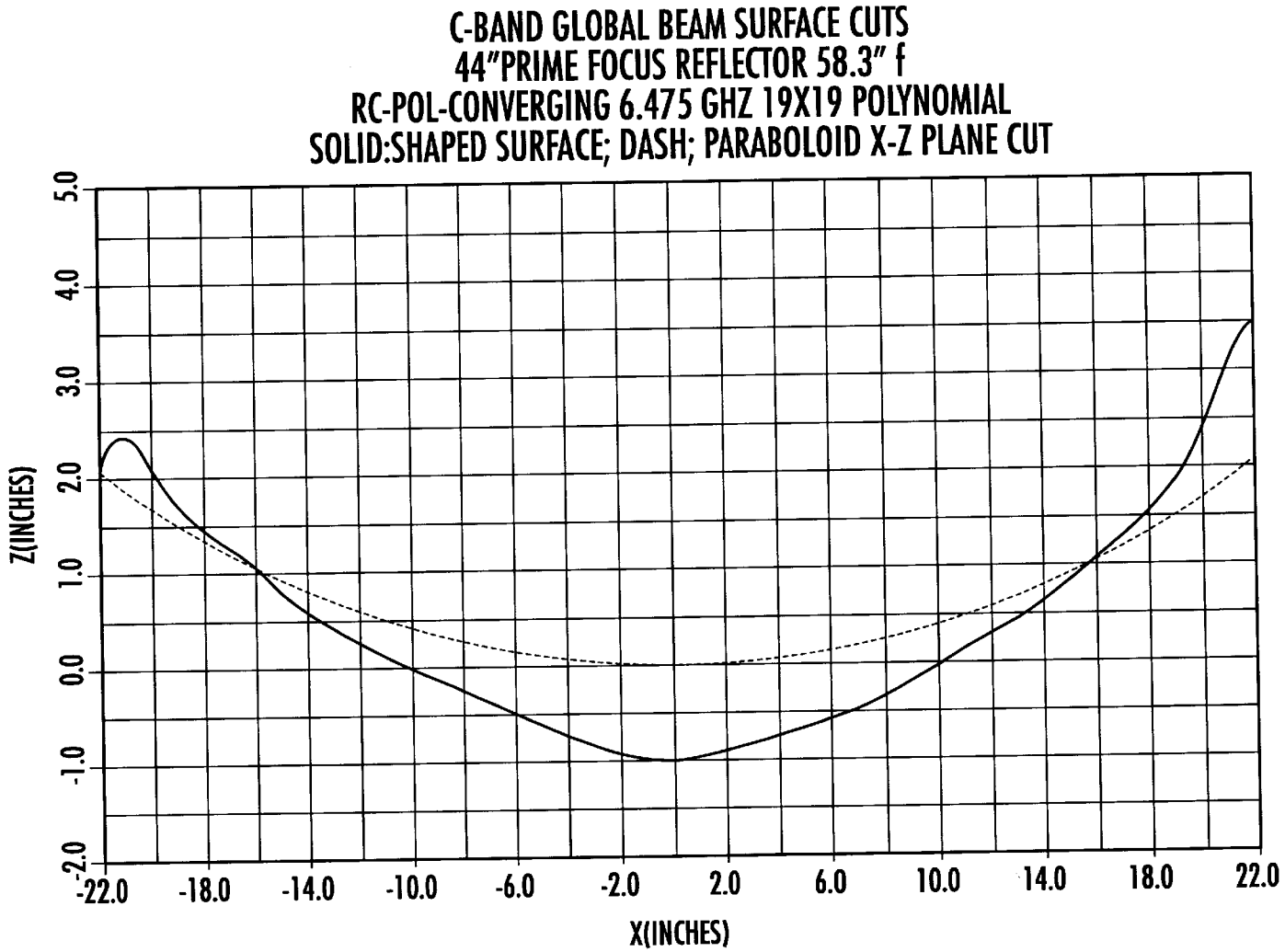

FIG. 6*a* illustrates surface deviation contours of a 44-inch converging shaped-surface prime focus reflector relative to the underlying parabola, to achieve the desired radiation pattern. The focal length of the reflector is 58.3", and the radiation is 6.475 GHz RHCP. In FIG. 6*a*, the contours include a contour at 0" deviation from the underlying parabola. As illustrated, the shaped reflector has a roughly circular central contour at −0.9" relative to the parabola, and the deviation from the parabola decreases with increasing distance from the center of the reflector, even past the 0" contour. As illustrated, the deviation continues to grow in a positive direction as distance increases from the 0" contour toward the outer edge of the reflector. More particularly, the contours progress from +0.2" to +0.4", +0.6", and to as much as +1.2" at the edge of the reflector. FIGS. 6*b* and 6*c* represent as dash lines plots of the underlying parabola and as solid lines the surface contour of the shaped reflector antenna in the xz and yz planes, respectively. The plots of FIGS. 6*b* and 6*c* are not symmetrical for reasons associated with the optimization techniques. Other possible solutions of the optimization might well be symmetrical.

Figure 6D:
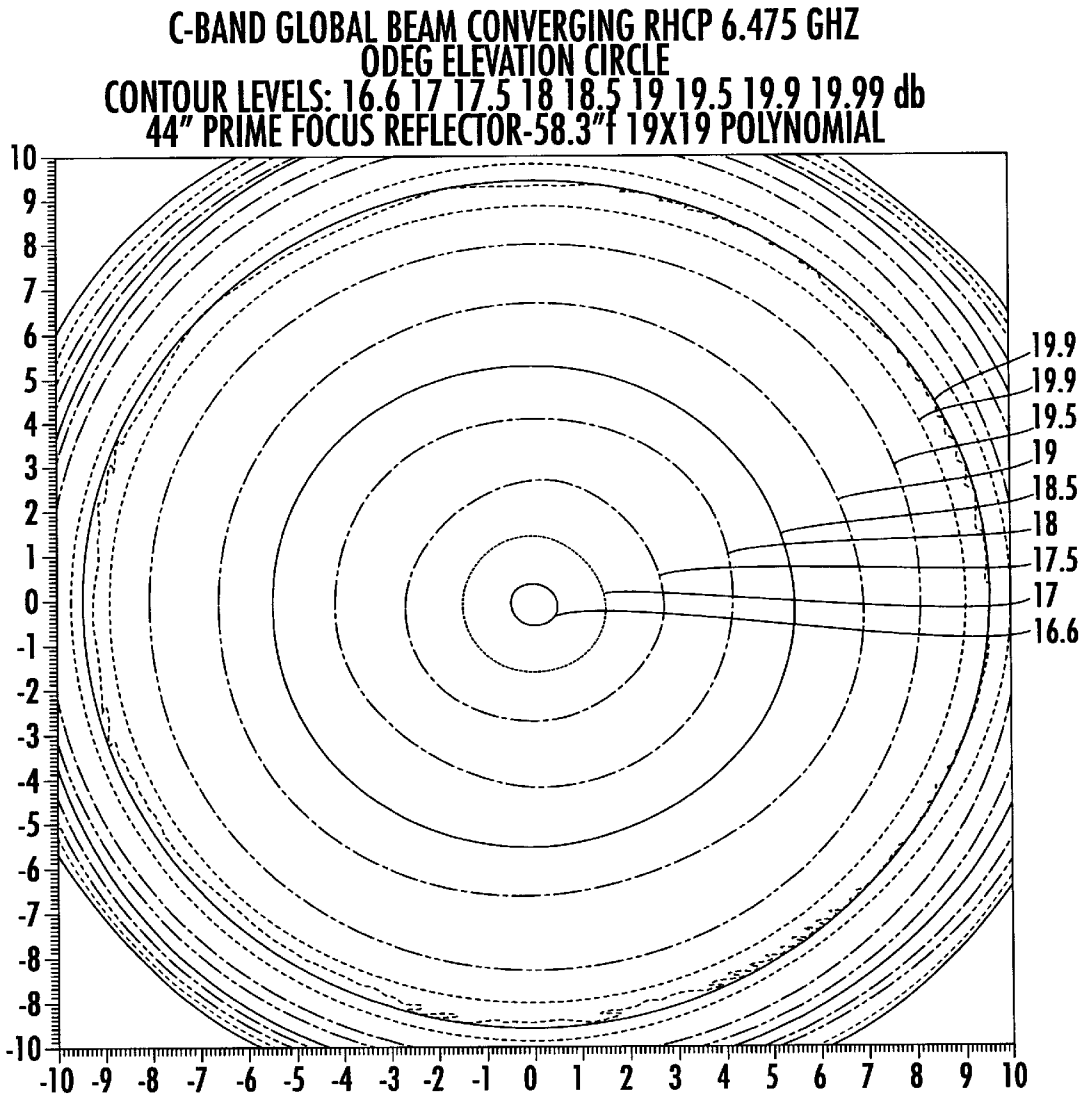
FIG. 6*d* is a calculated plot of the far-field radiation or directivity pattern of the reflector antenna of FIG. 6*a,* FIG. 6*e* is a calculated azimuth plot of the radiation pattern of the reflector antenna of FIG. 6*a,* and FIG. 6*f* is a calculated elevation plot of the radiation pattern of the reflector antenna of FIG. 6*a;*
Figure 6E:
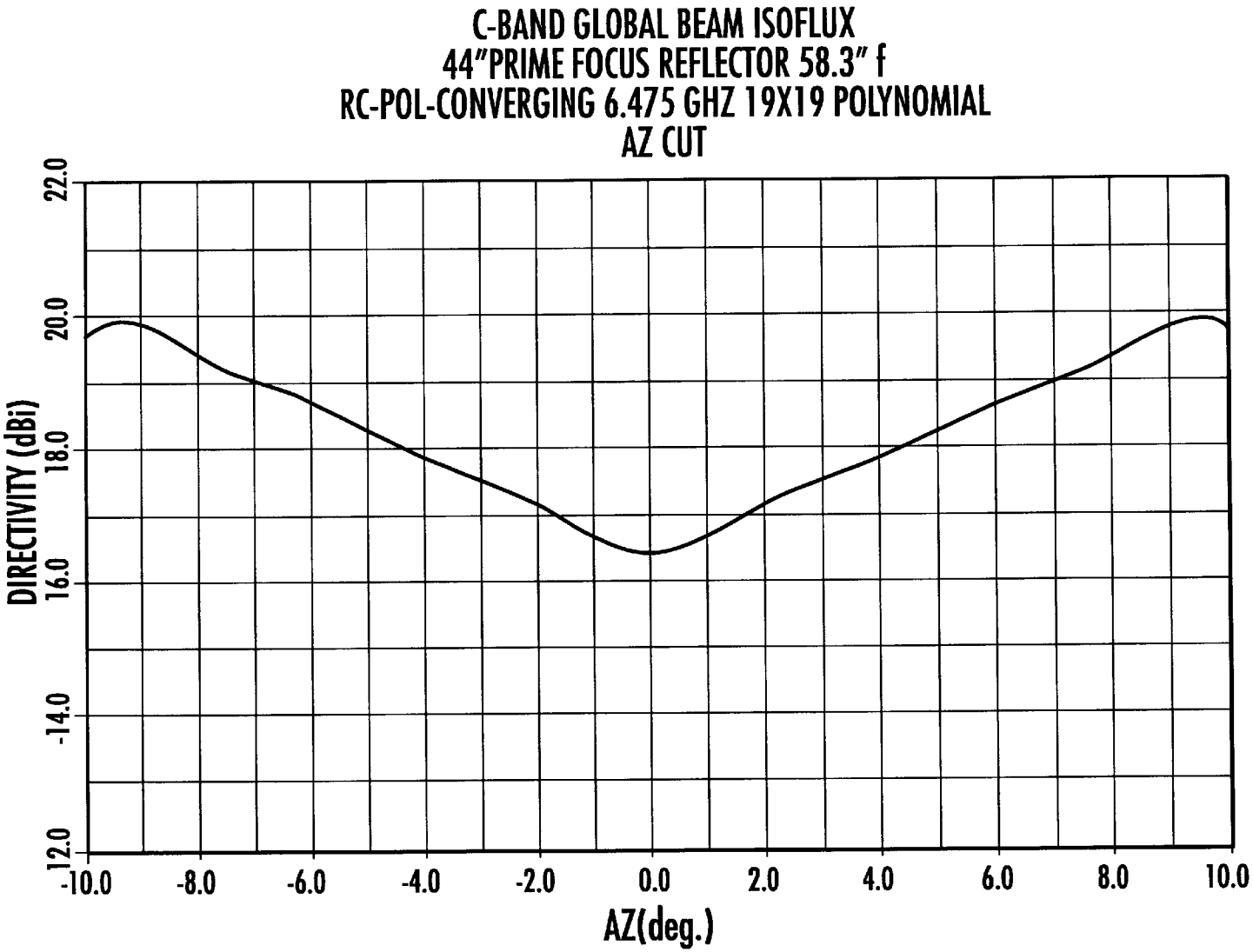
Figure 6F:
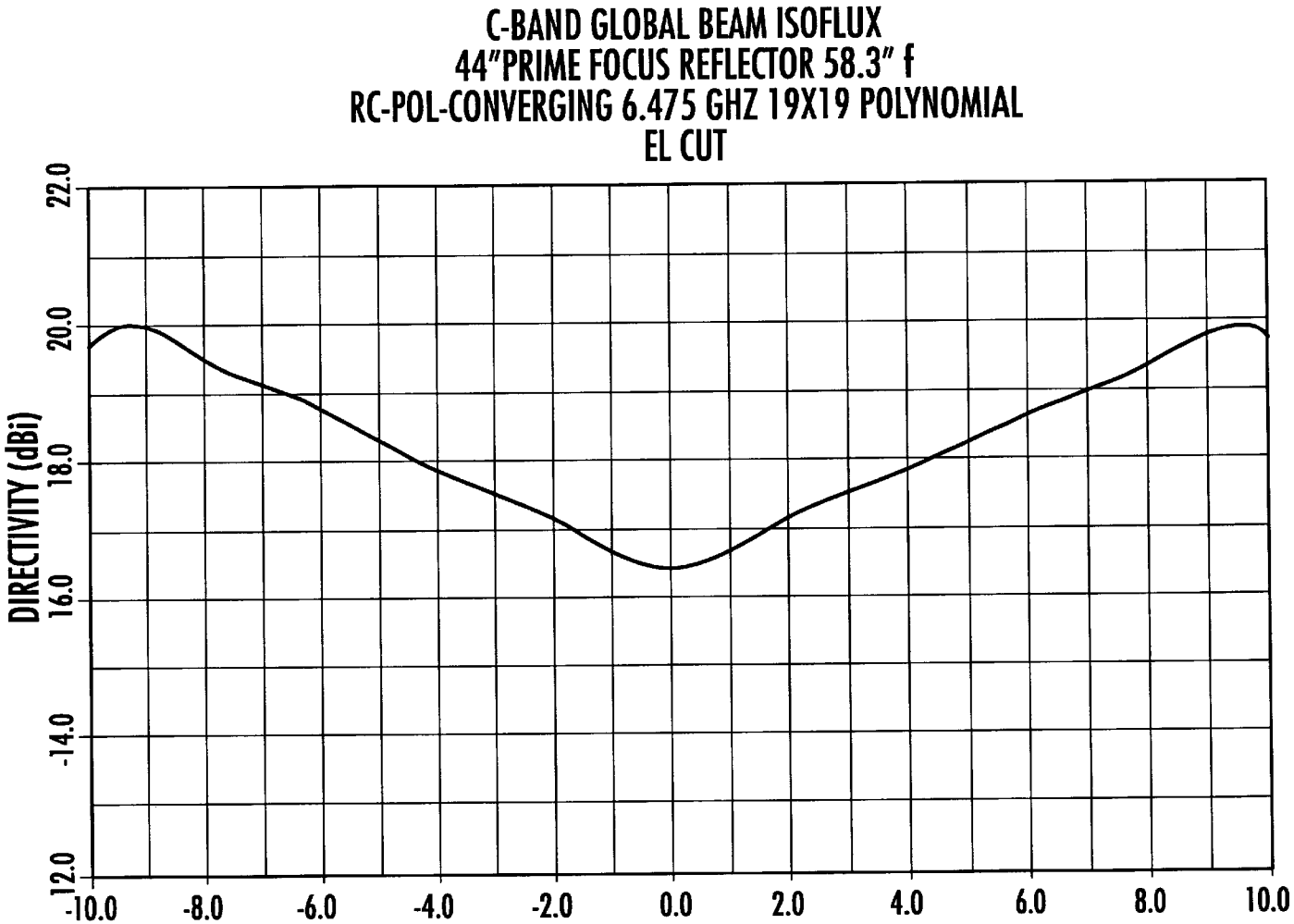

In general, the solid-line shaped reflector surfaces of FIGS. 6*b* and 6*c* both exhibit surface contours which are identical to those of the underlying dash-line parabola at about 17/22 of the radius, and which are concave as seen from the feed at all central locations, and more remote from the feed than the parabola at locations between the center and the equal-distance contour, and which are closer to the feed at locations lying outside of the equal-distance contour. FIG. 6*d* illustrates the directivity contours of the reflector antenna, and FIGS. 6*e* and 6*f* illustrate the directivity in two orthogonal cuts or planes. As illustrated in FIGS. 6*e* and 6*f*, the directivity of the converging prime-focus antenna is very similar to that of the diverging antennas of FIGS. 3*a*, 3*d*, 3*e*, 3*f*, 4*a*, 4*d*, 4*e*, and 4*f*.

Figure 7A:
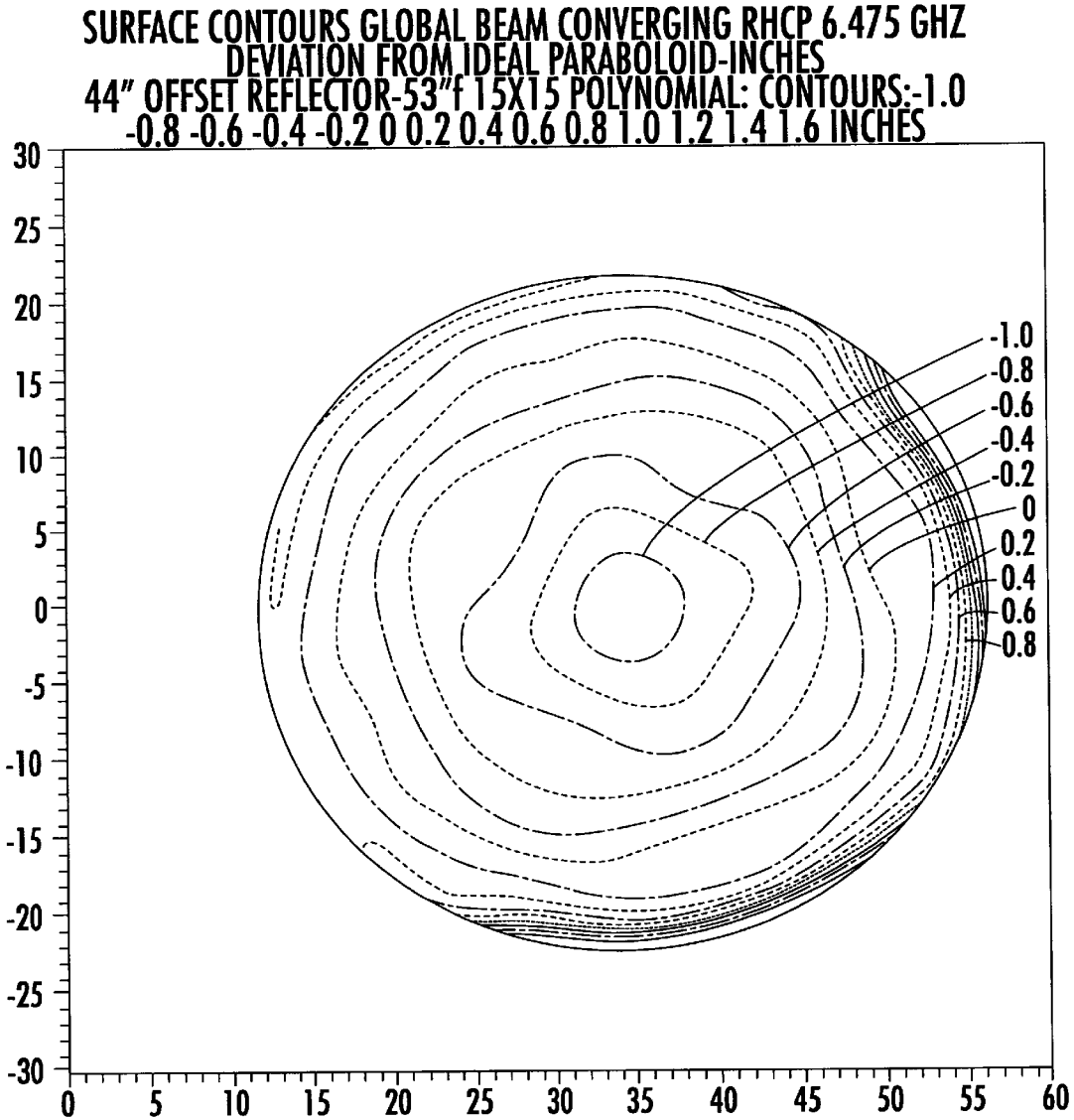
FIG. 7*a* is a plot of calculated surface contours of a shaped-reflector antenna relative to those of a parabola according to an embodiment of the invention for the case of a conversing offset-feed reflector.
Figure 7B:
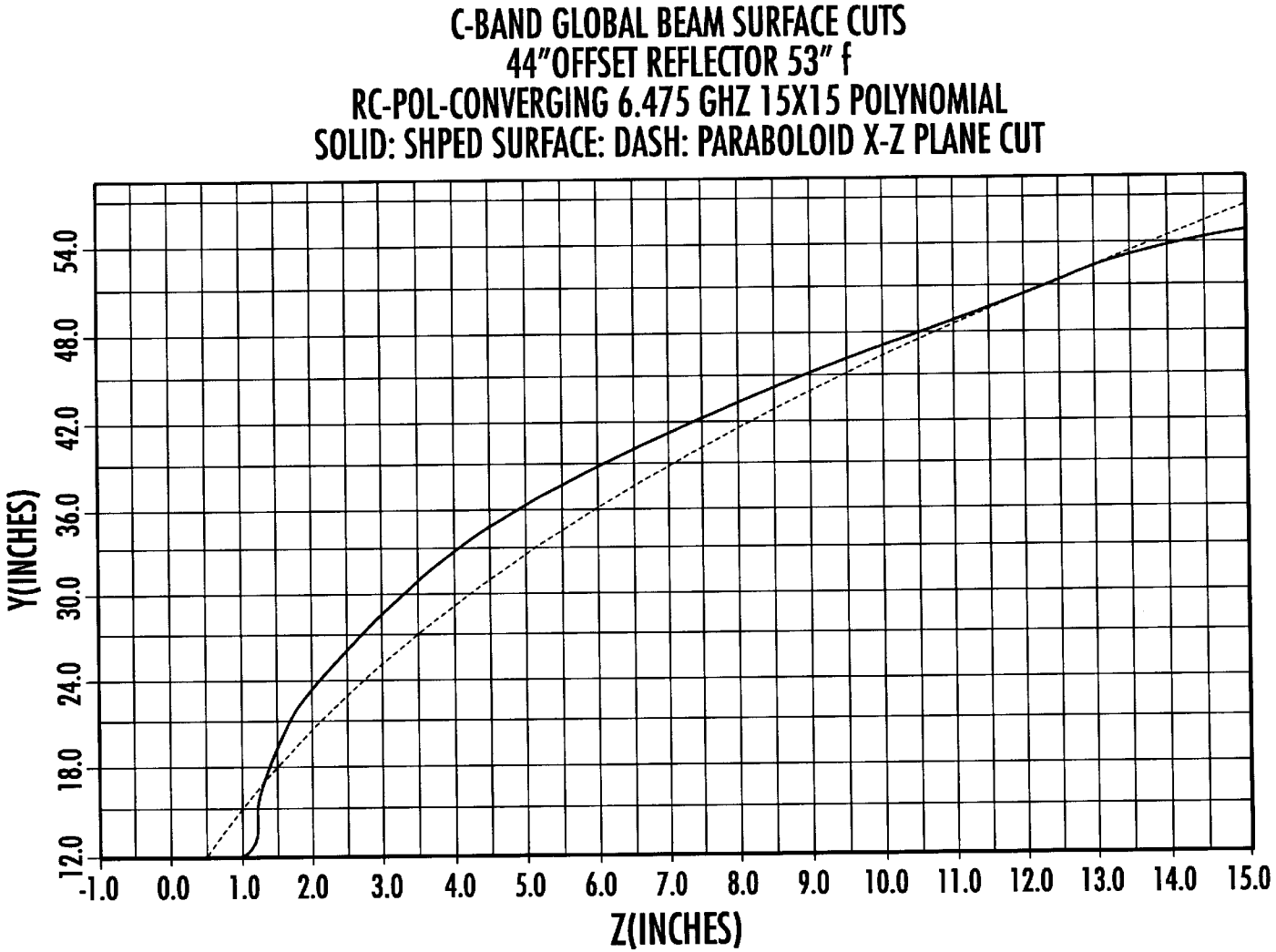
FIGS. 7*b* and 7*c* represent plots of the surface contour of the reflector antenna of FIG. 7*a* in the xz and yz planes, respectively.
Figure 7C:
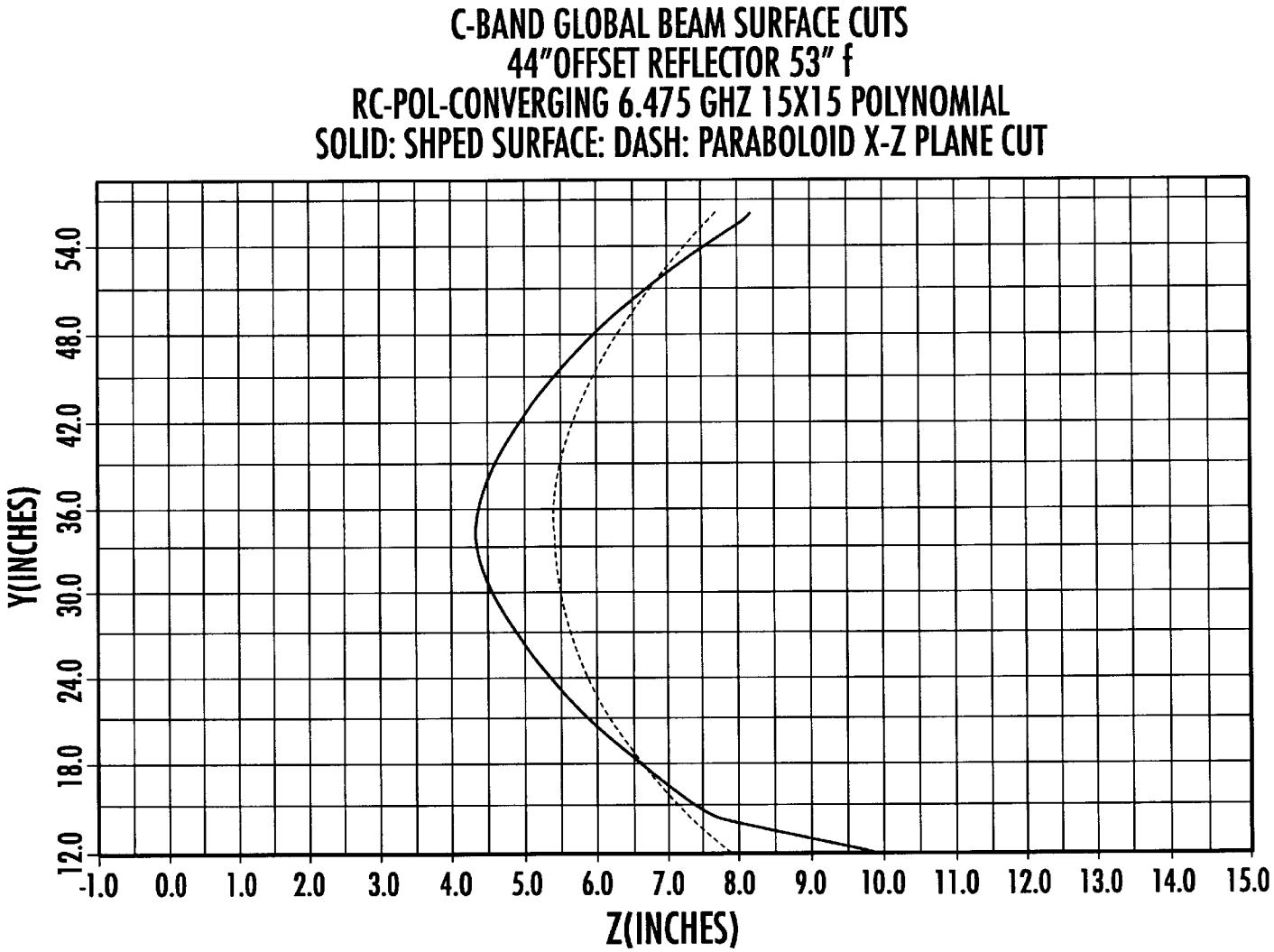
Figure 7D:
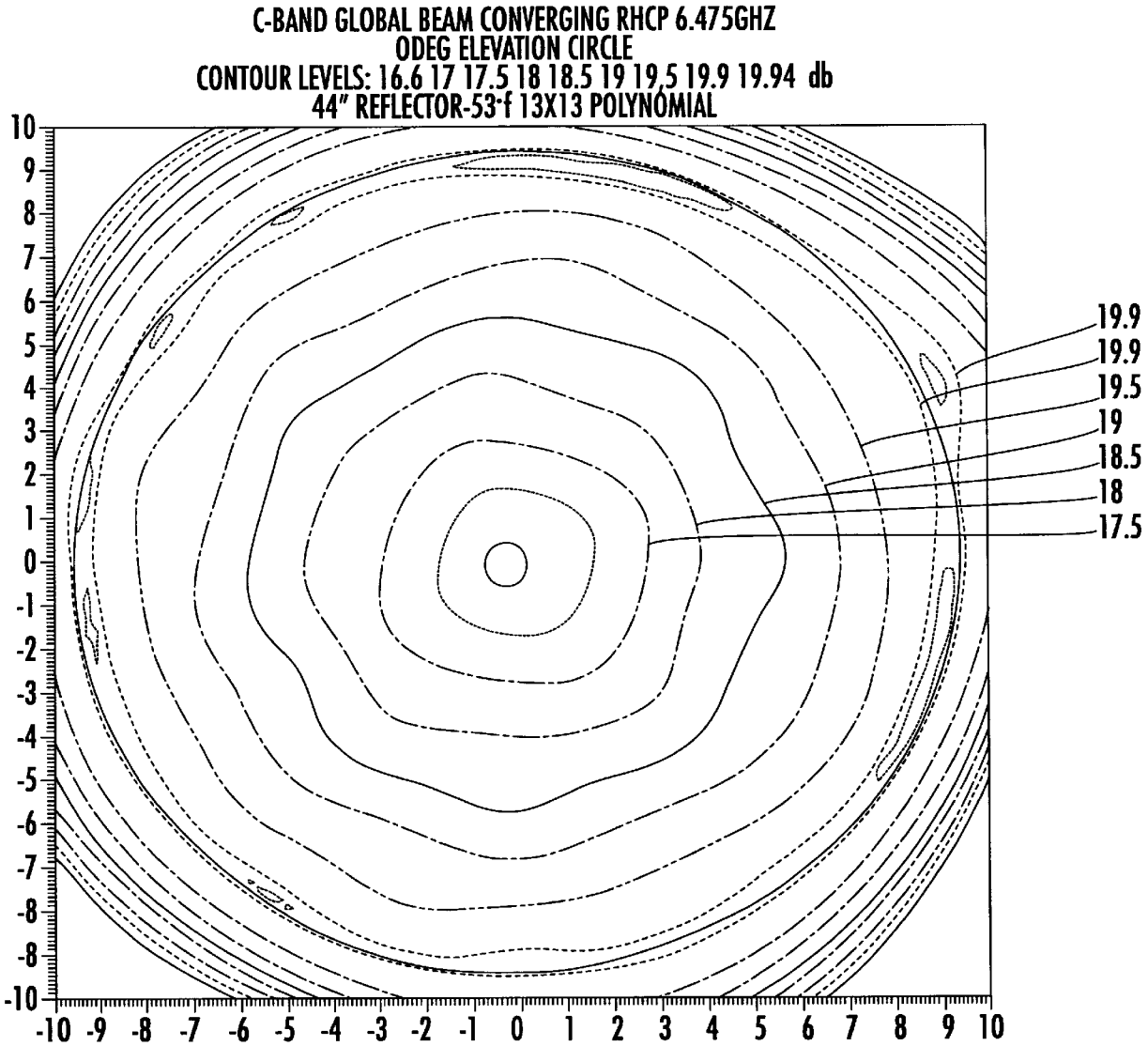
FIG. 7*d* is a calculated plot of far-field radiation or directivity contours of the reflector antenna of FIG. 7*a,* FIG. 7*e* is a calculated azimuth plot of the radiation pattern of the reflector antenna of FIG. 7*a*.
Figure 7E:
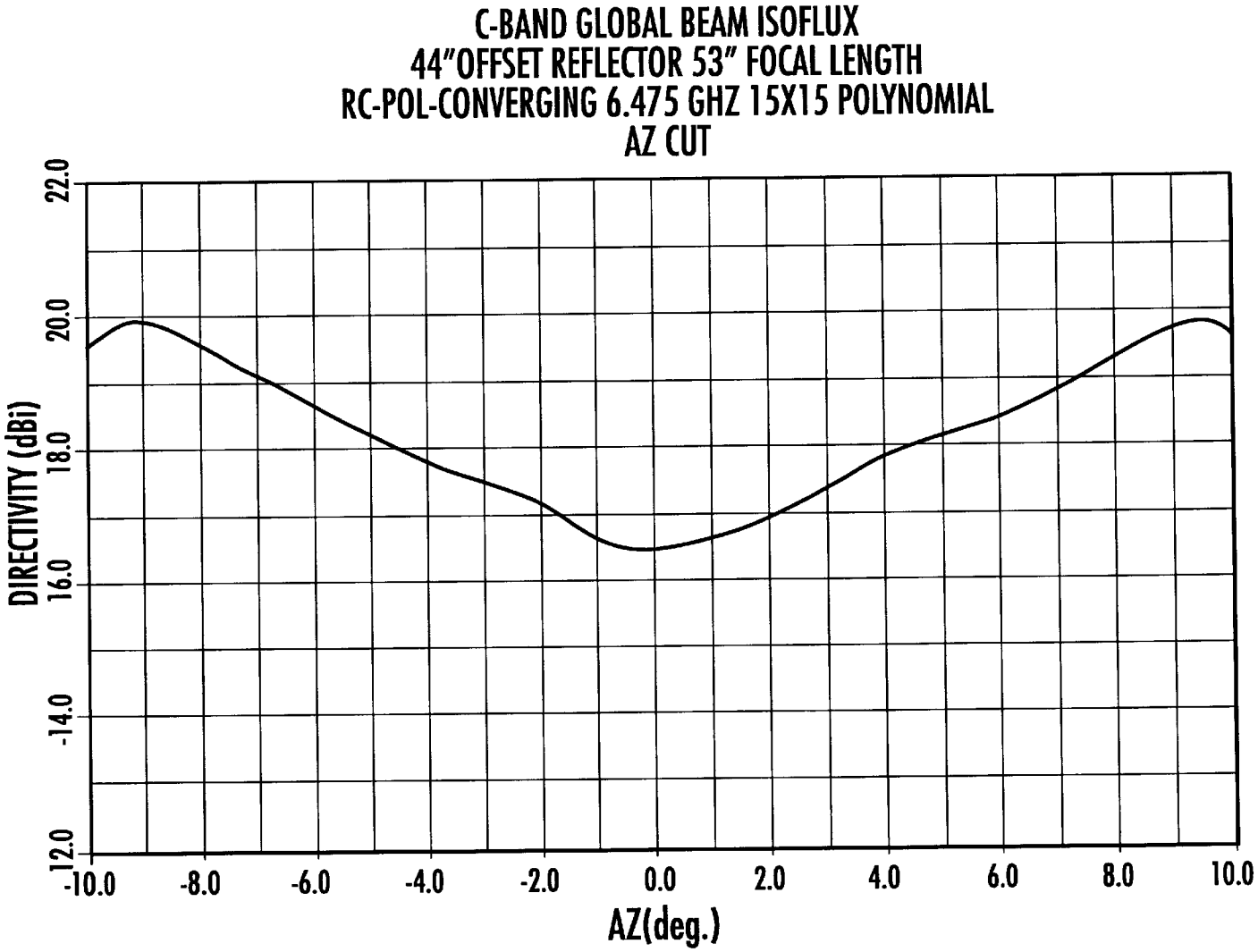
FIG. 7*f* is a calculated elevation plot of the radiation pattern of the reflector antenna of FIG. 7*a*
Figure 7F:
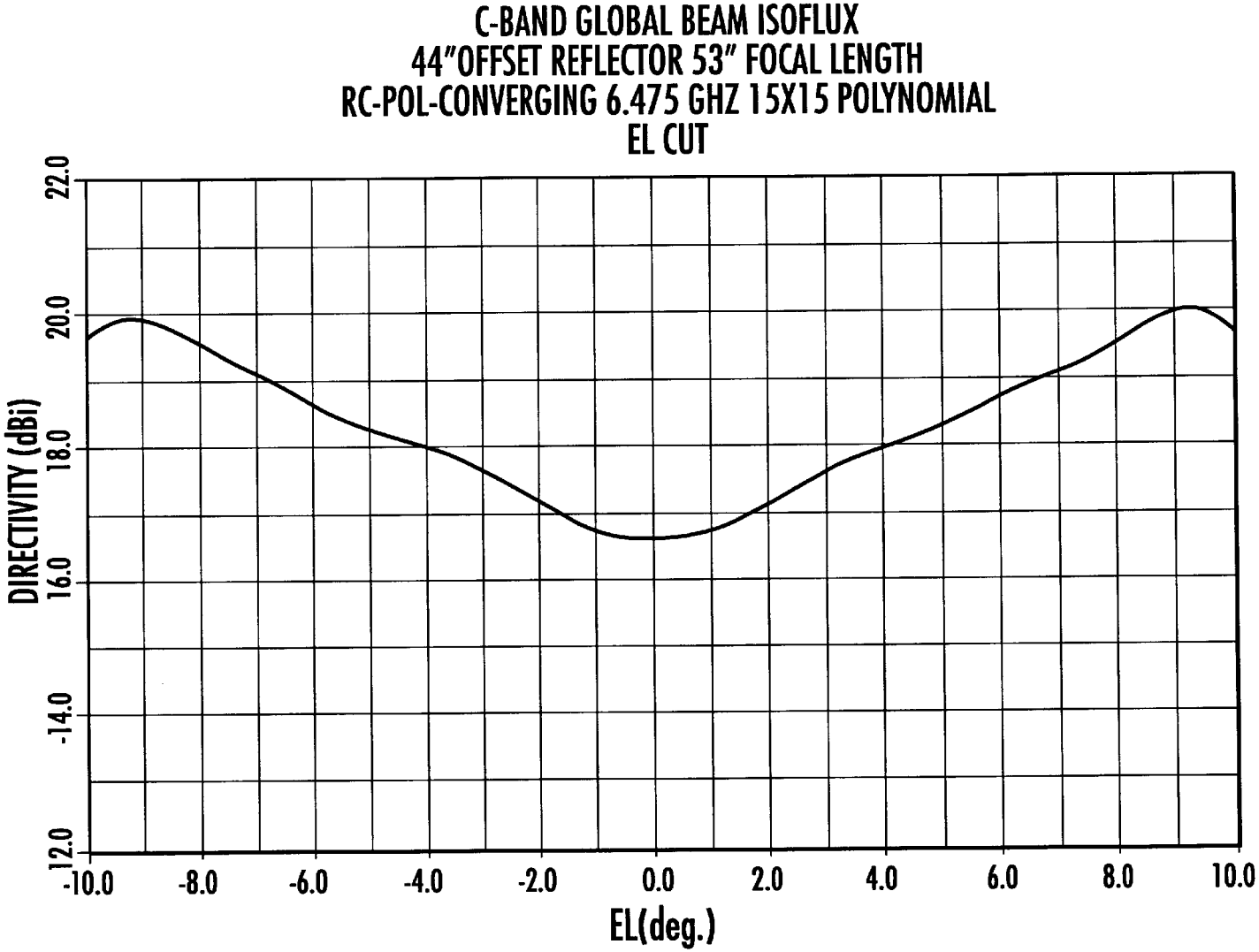

FIG. 7*a* illustrates surface deviation contours of a 44-inch converging shaped-surface offset-feed reflector relative to the underlying parabola, to achieve the desired radiation pattern. The focal length of the reflector is 58.3", and the radiation is 6.475 GHz RHCP. In FIG. 7*a*, the contours include a contour at 0" deviation from the underlying parabola. As illustrated, the shaped reflector has a roughly circular central contour at −1.0" relative to the parabola, and the deviation from the parabola decreases in a positive direction with increasing distance from the center of the reflector, even past the 0" contour. With increasing distance from the center of the reflector, the contours are −1.0", −0.8", −0.6", −0.4". and −0.2". As illustrated, the deviation from the underlying parabola continues to grow in a positive direction as distance increases from the 0" contour toward the outer edge of the reflector. More particularly, the contours progress from +0.2" to +0.4", +0.6", and to as much as +1.2" at the edge of the reflector. FIGS. 7*b* and 7*c* represent by dash lines the underlying parabola of the antenna of FIG. 7*a* and by solid lines the surface contour of the shaped reflector of FIG. 7*a* in the xz and yz planes, respectively. In general, the solid-line shaped reflector surfaces of FIG. 7*c* exhibits surface contours which are identical to those or the underlying dash-line parabola at about 17/22 or 18/22 of the radius, and which are concave as seen from the feed at central locations, and more remote from one feed than the parabola at locations between the center and the equal-distance contour, and which are raised above the underlying parabola at locations lying outside of the equal-distance contour. More specifically, in FIG. 7*c*, the equal-distance contour is at the crossing of the solid and dashed lines, which occurs at about 18 and 52 inches, where the center of the shaped reflector is at 34 inches. Consequently, the equal-distance points are at about 34–17 or 17 inches and at 52–34 inches or 18 inches. From the center of the shaped reflector of FIG. 6*b* to the ±17 inch equal-distance points, the shaped surface contour is below the contour of the underlying parabola, which is on the side remote from the feed. From the equal-distance points to the outside of the shaped reflector, the shaped reflector surface lies on the feed side of the underlying parabola. In general, the shared reflector is monotonic in its progress from a depressed contour to a raised contour, except at the very edge of the reflector. FIG. 7*d* illustrates the directivity contours of the reflector antenna, and FIGS. 7*e* and 7*f* illustrate the directivity in two orthogonal cuts or planes. As illustrated in FIGS. 7*e* and 7*f*, the directivity of the converging prime-focus antenna is very similar to that of the diverging antennas of FIGS. 3*a*, 3*d*, 3*e*, 3*f*, 4*a*, 4*d*, 4*e*, and 4*f*.

Figure 8A:
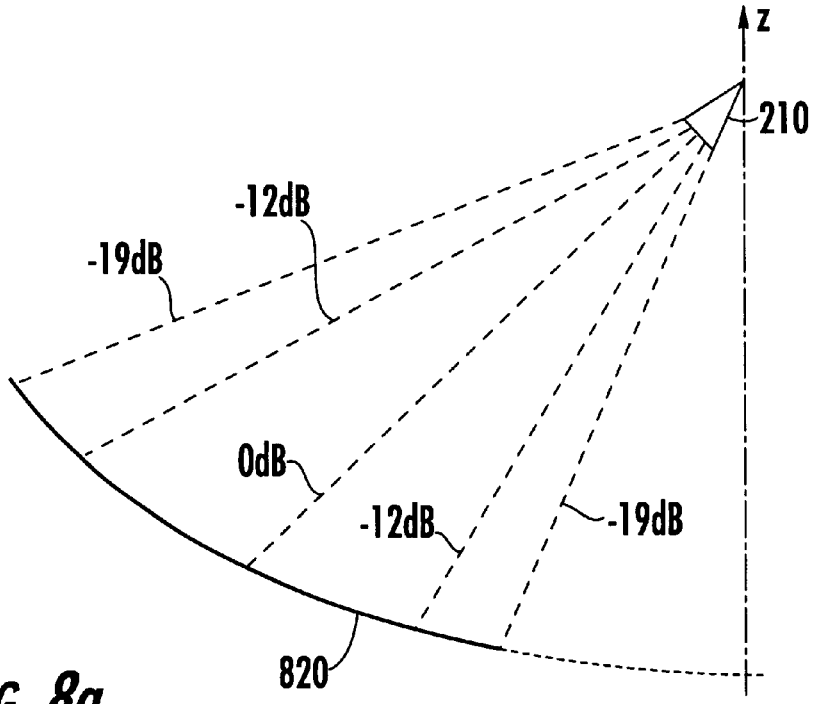
FIG. 8*a* represents a shaped reflector antenna intercepting the feed beam at about the −19 dB level and FIG. 8*b* represents a shaped reflector antenna intercepting the feed beam at about the −12 dB level.
Figure 8B:
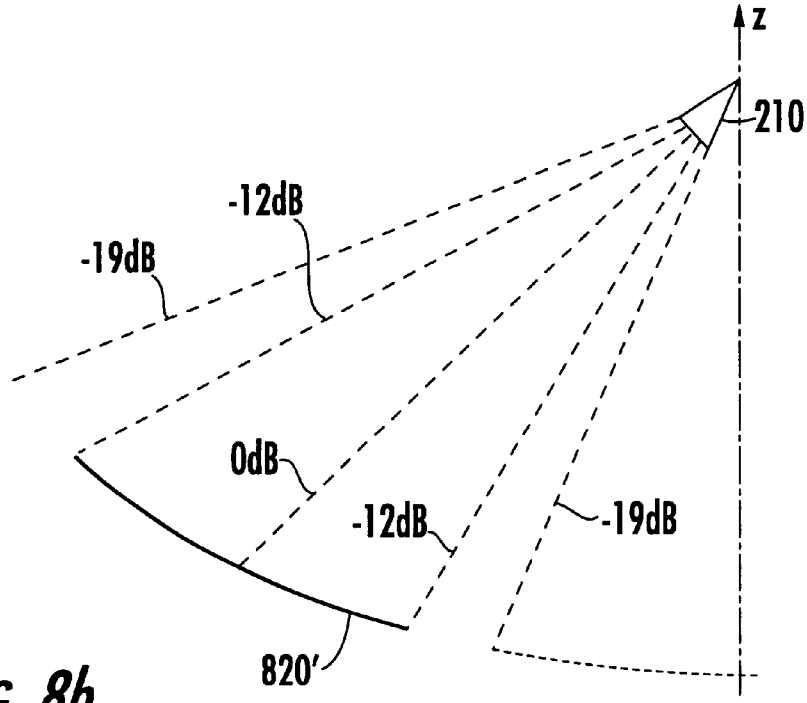

FIG. 8*a* represents a shaped reflector 820 with an offset feed antenna 210. As illustrated, the feed antenna 210 produces a feed-beam peak level of 0 dB near the center of reflector 820, and the reflector extends so as to intercept the feed beam near the −19 dB contour of the feed beam. Since the −19 dB contour is intercepted by reflector 820, other contours, such as the −12 dB contour, which lie between the 0 dB peak level and the −19 dB contour, are also intercepted. FIG. 8*b* represents a shaped reflector 820' with the same feed antenna 210. As illustrated in FIG. 8*b*, the reflector 820' intercepts the 0 dB feed beam peak, and also intercepts the −12 dB feed beam contour. However, reflector 820' does not extend sufficiently to intercept the −19 dB feed beam contour. In general, the lower the feed-beam level which is intercepted by the edge of the reflector, the lower the unwanted sidelobes of the radiation pattern. Thus, for low sidelobes, the arrangement of FIG. 8*a* is qualitatively superior to the arrangement of FIG. 8*b*, and this is so even if the diameters of the reflectors 820, 820' are the same (although if they were the same, the feed antenna beam would have to be different for each one in order to have the situation depicted in FIGS. 8*a* and 8*b*).

Other embodiments of the invention will be apparent to those skilled in the art. For example, while the described contours are suitable for a 44" diameter reflector and the selected feed antenna location characteristics, different diameters or feed antenna location or characteristics will result in some deviation of the contour magnitudes and locations. While the theoretical distances for geosynchronous orbit are specified, it will be understood that exact maintenance of the orbital distances will not affect the geometry or principles of the antenna according to the invention.

Thus, a reflector antenna (16, 510) for providing Earth coverage from a geosynchronous spacecraft (14) comprises a feed (210) radiator for producing a directive feed (210) beam (514), and a reflector (512, 532) intercepting the feed (210) beam (514). The reflector (216, 512, 532) is shaped for generating a generally axially symmetric reflector antenna (16) beam (18, 516, 526) about a beam (18, 516, 526) axis (8, 8'), which symmetric reflector antenna (16) beam (18) has a directivity an the range of about fourteen or fifteen db at the beam (18) center or on the beam (18) axis (8, 8'), with the directivity increasing to about eighteen dB at angles of about 9° from the axis (8).

In a particular embodiment, the reflector (216) has a surface contour (220) in at least a first plane (6, 8) which includes a convex center portion (222) which is convex in a center region of the reflector (216) as seen from the feed (210). The reflector (216) also has a convex edge portion (224*r*, 224*l*) adjacent the edge of the reflector (216), which convex edge portion (224*r*, 224*l*) is convex as seen from the feed (210). The reflector (216) also has a further concave portion (226*r*, 226*l*), as seen from the feed (210), in a region lying between, and connecting, the convex center (222) and edge (224*r*, 224*l*) portions. In one version of this embodiment, the feed (210) is offset from an axis (6) of the reflector (216), and lies in a second plane (5, 6) orthogonal to the first plane (4, 6). In this version, the reflector (216) has a surface contour (220) in the second plane (5, 6) in which the convex center portion (232) has a maximum projection which is offset (O) in the same direction as the feed (210) is offset from the axis (6) of the reflector (216).

Another avatar of the invention lies in a shaped reflector based on an underlying parabola, in which the shaping to provide the desired radiation pattern results in the shaped reflector which has, in at least one plane, a contour substantially equal to that of the underlying parabola at a radius of about 17/22 or 18/22 of the radius, and which is concave at all locations, except possibly at the very edge of the reflector. In this avatar, that portion of the shaped reflector more central than the equal-distance contour is depressed below that of the underlying parabola as seen from the feed side, that portion more remote from the center than the equal-distance contour is raised above the surface of the underlying parabola, and the increase of the surface location relative to the underlying parabola increases monotonically with increasing distance from the center, except, in some versions, at the very edge of the reflector.

In another manifestation of the invention, the reflector (820'; 216) subtends only that portion of the directive feed (210) beam which exhibits power levels greater than about 13 dB below the peak power level exhibited by the feed (210) antenna beam. (corresponding to values of −12 dB, −11 dB, . . . , −1 dB, 0 dB), for providing a particular level of sidelobes of said reflector antenna (16) beam (18). In another version or this manifestation which provides lower sidelobes than the 12-dB intercept, the reflector (820; 216) subtends only that portion of the directive feed (210) beam which exhibits power levels greater than about 19 dB below the peak power level exhibited by the feed (210) antenna beam, corresponding to interception of feed antenna beam levels in the range from 0 dB to −19 dB.

What is claimed is:

1. A reflector antenna, said antenna comprising:

a feed radiator for producing a directive feed beam; and a shaped reflector intercepting said feed beam of said feed radiator, said reflector being shaped for generating a generally axially symmetric beam about an axis, having a gain of about fourteen to fifteen db at the beam center, increasing by about three to four dB at angles of about 9° from the axis.

2. The antenna according to claim 1, wherein said reflector has a surface contour in at least a first plane which includes a convex center portion which is convex in a center region as seen from said feed radiator, and also has a convex edge portion near the edge of said reflector, which convex edge portion is convex as seen from said feed radiator, and further has a concave portion as seen from said feed radiator in a region lying between and connecting said convex center and edge portions.

3. The antenna according to claim 2, wherein said feed radiator is offset from an axis of said reflector and lies in a second plane orthogonal to said first plane. and wherein said reflector has a surface contour in said second plane in which said convex center portion has a maximum projection which is offset from said axis of said reflector in the same direction as said feed radiator is offset.

4. The antenna according to claim 1, wherein said reflector has a surface contour derived from that of an underlying parabola, and in which said shaped reflector has said surface contour substantially equal to that of the underlying parabola at about 17/22 to 18/22 of the radius of the reflector, and in which said surface contour is depressed below that of the underlying parabola at locations more central than said equal surface contour, and raised above said underlying parabola at locations less central than said equal surface contour, and in which said surface contours progress in a monotonic manner from said center to at least a location near the edge of said reflector.

5. The antenna according to claim 1, wherein said reflector subtends that portion of said feed antenna beam which exhibits power levels greater than 12 dB below the peak power level exhibited by said feed antenna beam.

6. The antenna according to claim 5, wherein said reflector subtends that portion of said feed antenna beam which exhibits power levels greater than about nineteen dB below the peak power level exhibited by said feed antenna beam.

7. A reflector antenna, said antenna comprising:

a feed radiator for producing a directive feed beam; and a shaped reflector intercepting said feed beam of said feed radiator, said reflector being shaped for generating a generally axially symmetric beam about an axis, and having a gain of about fourteen to fifteen db at the beam center, increasing to about eighteen dB at angles of about 9° from the axis, said shaped reflector having a surface contour in at least a first plane which includes a generally central convex region as seen from the feed side of said reflector, said surface contour also including a further convex region near the outer edge of said shaped reflector and a concave region lying between said central convex region and said further convex region.

* * * * *